US009326329B2

(12) United States Patent
Kitaizumi et al.

(10) Patent No.: US 9,326,329 B2
(45) Date of Patent: Apr. 26, 2016

(54) INDUCTION HEATING APPARATUS

(75) Inventors: Takeshi Kitaizumi, Kyoto (JP); Yoichi Kurose, Kyoto (JP); Akira Kataoka, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1012 days.

(21) Appl. No.: 13/393,483

(22) PCT Filed: Jan. 19, 2011

(86) PCT No.: PCT/JP2011/000261

§ 371 (c)(1), (2), (4) Date: Feb. 29, 2012

(87) PCT Pub. No.: WO2011/089900

PCT Pub. Date: Jul. 28, 2011

(65) Prior Publication Data

US 2012/0152935 A1 Jun. 21, 2012

(30) Foreign Application Priority Data

| | | |
|---|---|---|
| Jan. 20, 2010 | (JP) | 2010-009787 |
| Jun. 23, 2010 | (JP) | 2010-142315 |
| Oct. 1, 2010 | (JP) | 2010-223740 |
| Oct. 5, 2010 | (JP) | 2010-225330 |

(51) Int. Cl.

| | |
|---|---|
| ***H05B 6/06*** | (2006.01) |
| ***H05B 6/08*** | (2006.01) |
| ***H05B 6/04*** | (2006.01) |

(52) U.S. Cl.

CPC ..... *H05B 6/065* (2013.01)

(58) Field of Classification Search

CPC ..... H05B 6/065; H05B 6/04; H05B 6/067; H02M 5/458; H02M 2007/4815; Y02B 70/1441; Y02B 70/145

USPC ..... 219/661, 662, 632, 620, 622, 468, 486, 219/666, 671, 624; 373/144

See application file for complete search history.

(56) References Cited

U.S. PATENT DOCUMENTS

| | | | | |
|---|---|---|---|---|
| 7,504,607 | B2 * | 3/2009 | Barragan Perez et al. | 219/624 |
| 2008/0063025 | A1 * | 3/2008 | Fishman et al. | 373/144 |

* cited by examiner

*Primary Examiner* — Quang Van
(74) *Attorney, Agent, or Firm* — Brinks Gilson & Lione

(57) ABSTRACT

It is an object of the present invention to provide an induction heating apparatus that can enable a plurality of heating coil to perform heating by sharing a inverter having semiconductor switches in use, thereby adjusting a power without increasing losses of the semiconductor switches so much with respect to the respective heating coils, the present invention being configured such that the inverter alternately outputs drive signals respectively having each of two operating frequencies to the plurality of heating coils in every predetermined operation lapse of time and the plurality of heating coils are respectively connected to capacitance circuits in the inverter to have the different frequency characteristics.

15 Claims, 15 Drawing Sheets

INDUCTION HEATING APPARATUS

This application is a 371 application of PCT/JP2011/000261 having an international filing date of Jan. 19, 2011, which claims priority to JP2010-009787 filed Jan. 20, 2010, JP2010-142315 filed Jun. 23, 2010, JP2010-223740 filed Oct. 1, 2010, and JP2010-225330 filed Oct. 5, 2010, the entire contents of which are incorporated herein by reference.

TECHNICAL FIELD

The present invention relates to an induction heating apparatus which is capable of heating a plurality of objects simultaneously by utilizing induction heating by means of a high-frequency magnetic field.

BACKGROUND ART

A conventional induction heating apparatus includes a plurality of heating coils and a plurality of inverters respectively connected to the heating coils, so as to inductively heat a plurality of objects to be heated (for example, refer to U.S. Patent Application Publication No. 2007/0135037 (Patent Literature 1)).

FIG. 16 is a schematic diagram showing a configuration of the conventional induction heating apparatus. The conventional induction heating apparatus shown in FIG. 16 is configured to include a commercially available AC power supply 101, a rectification circuit 102 which rectifies an alternating current from the AC power supply 101, smoothing capacitors 103, 104 which smooth a voltage from the rectification circuit 102, a first inverter 105 and a second inverter 106 which convert the respective outputs of the smoothing capacitors 103, 104 into high-frequency powers, a first heating coil 107 and a second heating coil 108 which are supplied with the high-frequency powers from the first inverter 105 and the second inverter 106 respectively, and control means (not shown) such as a microcomputer which controls the first inverter 105 and the second inverter 106 etc. In the conventional induction heating apparatus having such a configuration, the two inverters 105 and 106 share the rectification circuit 102 in use to thereby simplify the circuit configuration of the rectification circuit 102, thereby reducing the number of components.

In the conventional induction heating apparatus shown in FIG. 16, the control means such as the microcomputer controls turn-on/-off operations of semiconductor switches in the first inverter 105 and the second inverter 106, thereby supplying necessary high-frequency currents to the first heating coil 107 and the second heating coil 108 connected to the first inverter 105 and the second inverter 106 respectively.

By means of the high-frequency currents supplied to the first heating coil 107 and the second heating coil 108, a high-frequency magnetic field occurs on the first heating coil 107 and the second heating coil 108. If loads such as a pan are placed on the first heating coil 107 and the second heating coil 108 on which the high-frequency magnetic field has occurred so as to be magnetically coupled with each other, the high-frequency magnetic field is applied on those loads respectively. By means of such a high-frequency magnetic field applied on the loads, an eddy current occurs through the loads, so that the loads themselves generate heat due to this eddy current and a skin resistance of the loads themselves such as the pan.

Further, in order to adjust the amount of heating the loads such as the pan, the control means controls a drive frequency and a duty ratio (conduction ratio) of the semiconductor switches in the first inverter 105 and the second inverter 106.

Patent Literature 1: U.S. Patent Application Publication No. 2007/0135037

SUMMARY OF THE INVENTION

Technical Problem

In the configuration of the conventional induction heating apparatus shown in FIG. 16, the inverters 105 and 106 respectively corresponding to the first heating coil 107 and the second heating coil 108 need to have the semiconductor switches. Hence, the drive circuit is required to control the turn-on/-off operations of the semiconductor switches in the respective inverters 105 and 106. As a result, the conventional induction heating apparatus has needed to respectively include the semiconductor switches in the plurality of inverters 105 and 106 and also secure an area in which a drive circuit for controlling those semiconductor switches is to be mounted and, therefore, has been difficult to be miniaturized.

Further, in the configuration of the conventional induction heating apparatus shown in FIG. 16, in a case where the first heating coil 107 and the second heating coil 108 operate simultaneously, it is necessary to prevent an interfering sound to occur due to a difference in operating frequency between the heating coils. To prevent the occurrence of such an interference sound, it has been necessary to control the semiconductor switches in the respective inverters 105 and 106 by taking measures, for example, driving the first heating coil 107 and the second heating coil 108 at the same frequency or driving them in condition where a difference in frequency not less than an audible band is held between them. The conventional induction heating apparatus has needed to control the semiconductor switches according to service conditions in such a manner and, therefore, suffered from complicated control of the semiconductor switches, having a problem in that it is difficult to design.

To solve the problems of the conventional induction heating apparatus, the present invention has been developed, and it is an object of the present invention to provide an induction heating apparatus which can be configured to enable an inverter having semiconductor switches to be shared in use so that a plurality of heating coils may efficiently produce heat simultaneously and securely adjust power without increasing losses so much due to the semiconductor switches with respect to the respective heating coils. It is another object of the present invention to provide an induction heating apparatus that can securely prevent an interfering sound from occurring due to a difference in operating frequency between a plurality of heating coils by using a simple configuration and be miniaturized by reducing the number of required components and an area to mount circuits.

Solution to Problem

The induction heating apparatus of the first aspect according to the present invention includes:

a smoothing circuit to which a rectified power from an AC power supply is input;

an inverter in which the smoothed power is input to a semiconductor switch circuit from the smoothing circuit and which alternately outputs drive signals respectively having each of two operating frequencies respectively in every predetermined operation period of time;

a plurality of heating coils which are supplied with the drive signals from the inverter and connected to capacitance circuits in the inverter to have the different frequency characteristics; and a control portion for controlling the operating frequencies and the operation period of time to drive the semiconductor switch circuit. The induction heating apparatus of the first aspect according to the present invention having such a configuration can enable the plurality of heating coils to perform heating operations and efficiently adjust a power without increasing losses of the semiconductor switches so much with respect to the respective heating coils. Further, the induction heating apparatus of the present invention can prevent occurrence of an interfering sound due to a difference in operating frequency between the plurality of heating coils and be miniaturized by reducing the number of components and a circuit mounting area.

In the induction heating apparatus of the second aspect according to the first aspect of the present invention, a set of the semiconductor switch circuits is formed by a series circuit including two semiconductor switches, and by alternating turn-on and turn-off operations of the two semiconductor switches, the smoothed power from the smoothing circuit may be supplied to the plurality of heating coils connected to a connecting point of the two semiconductor switches connected in series. The induction heating apparatus of the second aspect according to the present invention having such a configuration can prevent occurrence of an interfering sound due to a difference in operating frequency between the plurality of heating coils and be miniaturized by reducing the number of components and the circuit mounting area.

In the induction heating apparatus of the third aspect according to the second aspect of the present invention, the plurality of heating coils are respectively connected in series with a plurality of capacitance circuits provided in the inverter, and a plurality of resonant circuits including the plurality of heating coils and the plurality of capacitance circuits have different resonant frequency values in frequency characteristics, respectively. The induction heating apparatus of the third aspect according to the present invention having such a configuration can efficiently adjust the power without increasing losses of the semiconductor switches so much with respect to the respective heating coils.

In the induction heating apparatus of the fourth aspect according to the third aspect of the present invention, each of the series circuits that include the plurality of heating coils and the plurality of capacitance circuits are connected between the connecting point of the two semiconductor switches connected in series and one output terminal of the smoothing circuit. The induction heating apparatus of the fourth aspect according to the present invention having such a configuration can prevent occurrence of an interfering sound due to a difference in operating frequency between the plurality of heating coils and be miniaturized by reducing the number of components and the circuit mounting area.

In the induction heating apparatus of the fifth aspect according to the third aspect of the present invention, each of the plurality of capacitance circuits includes a plurality of capacitance elements and connected in parallel with the smoothing circuit, and each of the plurality of heating coils is respectively connected between nodes between the capacitance elements of the capacitance circuits and the connecting point of the two semiconductor switches connected in series. The induction heating apparatus of the fifth aspect according to the present invention having such a configuration can prevent occurrence of an interfering sound due to a difference in operating frequency between the plurality of heating coils and be miniaturized by reducing the number of components and the circuit mounting area.

In the induction heating apparatus of the sixth aspect according to the fourth aspect of the present invention, the induction heating apparatus comprises switching portions (19, 20) which are fitted to the series circuits that include the plurality of heating coils and the plurality of capacitance circuits so as to enable each of the plurality of heating coils to be disconnected from or connected to the inverter. The induction heating apparatus of the sixth aspect according to the present invention having such a configuration can efficiently enable any one of the plurality of heating coils to perform standalone heating operations.

In the induction heating apparatus of the seventh aspect according to the fifth aspect of the present invention, a switching portion is fitted to each of the plurality of heating coils so as to enable each of the plurality of heating coils to be disconnected from and connected to the inverter. The induction heating apparatus of the seventh aspect according to the present invention having such a configuration can efficiently enable any one of the plurality of heating coils to perform standalone heating operations. Further, in the configuration of the induction heating apparatus of the seventh aspect, in the standalone heating operations, a capacitance of the capacitance elements in the resonant circuit out of use is added to that of the smoothing circuit, to stabilize the input power to the inverter and eliminate the need of setting a large capacitance of the smoothing circuit.

In the induction heating apparatus of the eighth aspect according to the third aspect of the present invention, one of the drive signals respectively having each of the two operating frequencies which are output by the inverter alternately is set in a frequency range higher than the resonant frequencies of the plurality of resonant circuits and the other is set in a middle range of the resonant frequencies of the plurality of resonant circuits. The induction heating apparatus of the eighth aspect according to the present invention having such a configuration can efficiently adjust the power without increasing losses of the semiconductor switches so much with respect to the respective heating coils.

In the induction heating apparatus of the ninth aspect according to the third aspect of the present invention, at least one of the drive signals respectively having each of the two operating frequencies which are output by the inverter alternately is set in a range other than the resonant frequency at the time of no load where no to-be-heated is placed. The induction heating apparatus of the ninth aspect according to the present invention having such a configuration can efficiently adjust the power.

In the induction heating apparatus of the tenth aspect according to the third aspect of the present invention, at least one of the drive signals respectively having each of the two operating frequencies which are output by the inverter alternately is set in a range other than the frequency range that denotes at least ½ of a maximum input power in the frequency characteristic at the time of no load where no to-be-heated object is placed. The induction heating apparatus of the tenth aspect according to the present invention having such a configuration avoids increasing losses of the semiconductor switches so much with respect to the respective heating coils.

In the induction heating apparatus of the eleventh aspect according to the third aspect of the present invention, an antiparallel diode is connected with each of the two semiconductor switch, so that in alternate turn-on/-off operations of the two semiconductor switches, each of those semiconductor switches is turned on at timing when a current starts to flow through this diode. The induction heating apparatus of the eleventh aspect according to the present invention having such a configuration can efficiently control the semiconductor switches without increasing losses of the semiconductor switches so much with respect to the respective heating coils.

In the induction heating apparatus of the twelfth aspect according to the third aspect of the present invention, the respective resonant frequencies in the frequency characteristics of the plurality of resonant circuits are separated by 20 kHz or more. The induction heating apparatus of the twelfth aspect according to the present invention having such a configuration can efficiently enable the plurality of heating coils to perform heating.

In the induction heating apparatus of the thirteenth aspect according to the third aspect of the present invention, the control portion is configured to control the operating frequencies and operation periods of time of the drive signals output from the inverter, based on an input current from the AC power supply and an input power to the heating coils. The induction heating apparatus of the thirteenth aspect according to the present invention having such a configuration can efficiently enable the plurality of heating coils to perform heating, thereby obtaining a desired power.

In the induction heating of the fourteenth aspect according to the third aspect of the present invention, the control portion is configured to determine the operation periods of time of the drive signals output from the inverter based on the input current from the AC power supply and the input power to the heating coils and then control a duty ratio of the semiconductor switches to thereby control powers to be supplied to the heating coils. The induction heating apparatus of the fourteenth aspect according to the present invention having such a configuration can efficiently enable the plurality of heating coils to perform heating, thereby obtaining a desired power.

In the induction heating apparatus of the fifteenth aspect according to the third aspect of the present invention, the plurality of heating coils have external shapes having different coil diameters, so that the resonant frequency of the resonant circuit including the heating coil having the smaller diameter is higher than the resonant frequency of the resonant circuit including the heating coil having the larger diameter. The induction heating apparatus of the fifteenth aspect according to the present invention having such a configuration can make the heating coil having the smaller external shape thinner than the other to improve the transmission efficiency of energy between the heating coils and the load, thereby simplifying a design for cooling.

Advantageous Effects of the Invention

According to the present invention, it is possible to provide an induction heating apparatus that can enable an inverter having semiconductor switches to be shared in use so that a plurality of heating coils may efficiently produce heat simultaneously and securely adjust power without increasing losses due to the semiconductors with respect to the respective heating coils. Further, in the induction heating apparatus of the present invention, an interfering sound is prevented from occurring due to a difference in operating frequency between the heating coils, while reducing the number of required components and an area in which circuits are mounted, so that the apparatus may be miniaturized.

DETAILED DESCRIPTION OF THE PREFERRED EMBODIMENTS

The following will describe examples of an induction heating cooker as embodiments of an induction heating apparatus according to the present invention with reference to the accompanying drawings. It is to be understood that the induction heating apparatus of the present invention is not limited to the induction heating cookers described in the following embodiments and includes the induction heating apparatus configured on the basis of the technological concepts equivalent to those described in the following embodiments and the technological common knowledge in the relevant field.

First Embodiment

Figure 1:
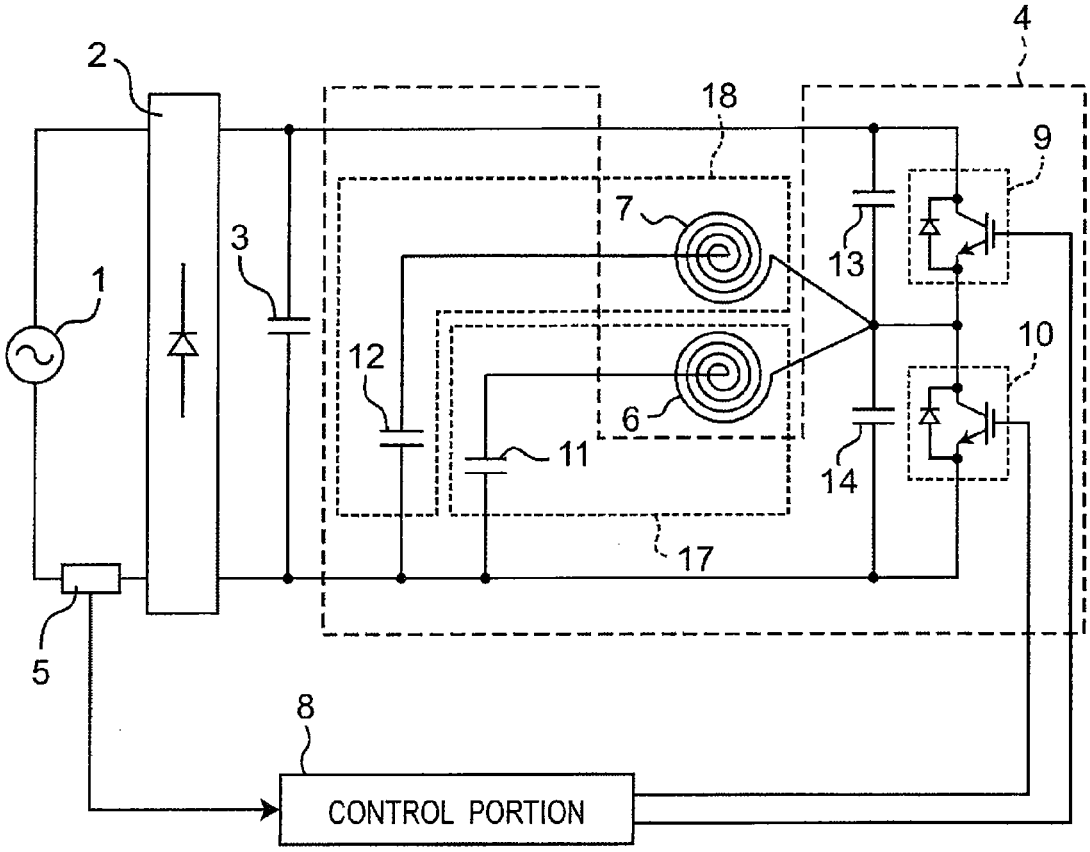
FIG. 1 is a schematic diagram showing a configuration of an induction heating cooker as one example of an induction heating apparatus of a first embodiment according to the present invention.

A description will be given of an induction heating cooker as one example of the induction heating apparatus of a first embodiment according to the present invention with reference to the drawings. FIG. 1 is a schematic diagram showing a configuration of the induction heating cooker of the first embodiment according to the present invention.

As shown in FIG. 1, the induction heating cooker as the induction heating apparatus of the first embodiment include a commercially available AC power supply 1, a rectification circuit 2 for rectifying an alternating current from the AC power supply 1, a smoothing capacitor 3 which is a smoothing circuit for smoothing a voltage from the rectification circuit 2, an inverter 4 for converting an output of the smoothing capacitor 3 into a high-frequency power, an input current detection portion 5 including a current transformer for detecting an input current input to the rectification circuit 2 from the AC power supply 1, a first heating coil 6 and a second heating coil 7 which are supplied with a high-frequency current from the inverter 4, and/or a control portion 8 for controlling a semiconductor switch circuit in the inverter 4 so that a value detected by the input current detection portion 5 may be a value set in this induction heating cooker.

The semiconductor switch circuit includes a series circuit having two semiconductor switches 9 and 10. A subject for which the control portion 8 controls the semiconductor switches 9 and 10 in the semiconductor switch circuit includes a current or a voltage of the heating coil besides an input current from the AC power supply 1. Although the first embodiment will be described with reference to the input current to the rectification circuit 2 as the subject for which the control portion 8 conducts control, the subject for which the control portion controls the semiconductor switch is not limited to the input current to the rectification circuit but includes a current and a voltage of the heating coil in addition to the input current.

In the inverter 4 in the induction heating cooker of the first embodiment, the series circuit having the first semiconductor switch 9 and the second semiconductor switch 10 is connected in parallel with the smoothing capacitor 3, which is a smoothing circuit. Each of the first semiconductor switch 9 and the second semiconductor switch 10 in the semiconductor switch circuit includes a power semiconductor made of an IGBT or an MOSFET and a diode which is connected in parallel with this power semiconductor in a reverse direction. Between collectors and emitters of the first semiconductor switch 9 and the second semiconductor switch 10, snubber capacitors 13 and 14 are connected in parallel with those semiconductor switches respectively in order to suppress a steep rise in voltage at a time when the semiconductor switches shift from the on-state to the off-state.

Between the midpoint of a series circuit including the first semiconductor switch 9 and the second semiconductor switch 10 and one terminal of the smoothing capacitor 3, a series circuit including the first heating coil 6 and a first resonant capacitor 11, which is an element of capacitance, is connected. Further, between the midpoint of a series circuit including the first semiconductor switch 9 and the second semiconductor switch 10 and the other terminal of the smoothing capacitor 3, a series circuit including the second heating coil 7 and a second resonant capacitor 12, which is an element of capacitance, is connected.

[Input Power Adjusting Operation in Induction Heating Cooker in the First Embodiment]

A description will be given of operations in the induction heating cooker of the first embodiment having the above configuration.

The control portion 8 puts the first semiconductor switch 9 and the second semiconductor switch 10 in the inverter 4 into the state of continuity (on-state) alternately to supply the first heating coil 6 and the second heating coil 7 with a high-frequency current having a frequency in a range between, for example, 20 kHz and 60 kHz. The high-frequency current supplied in such a manner causes the first heating coil 6 and the second heating coil 7 to produce a high-frequency magnetic field. The produced high-frequency magnetic field is applied to a load such as a pan placed above the first heating coil 6 and the second heating coil 7. The high-frequency magnetic field applied to the load such as the pan produces an eddy current on the surface of the load, so that the load is heated by induction heating due to the eddy current and a high-frequency resistance of the load itself.

In the inverter 4 having the above configuration, in the case of heating the load such as the pan placed above the first heating coil 6, a first frequency characteristic is provided which has a first resonant frequency (f1) determined by an inductance (L1) of the first heating coil 6 coupled with the load and a capacitance (C1) of the first resonant capacitor 11. The first resonant frequency (f1) of the first frequency characteristic is roughly determined by $1/(2\pi\sqrt{(L1\times C1)})$.

Further, in the case of heating the load such as the pan placed above the second heating coil 7, a second frequency characteristic is provided which has a second resonant frequency (f2) determined by an inductance (L2) of the second heating coil 7 coupled with the load and a capacitance (C2) of the second resonant capacitor 12. The second resonant frequency (f2) of the second frequency characteristic is roughly determined by $1/(2\pi\sqrt{(L2\times C2)})$.

Figure 2:
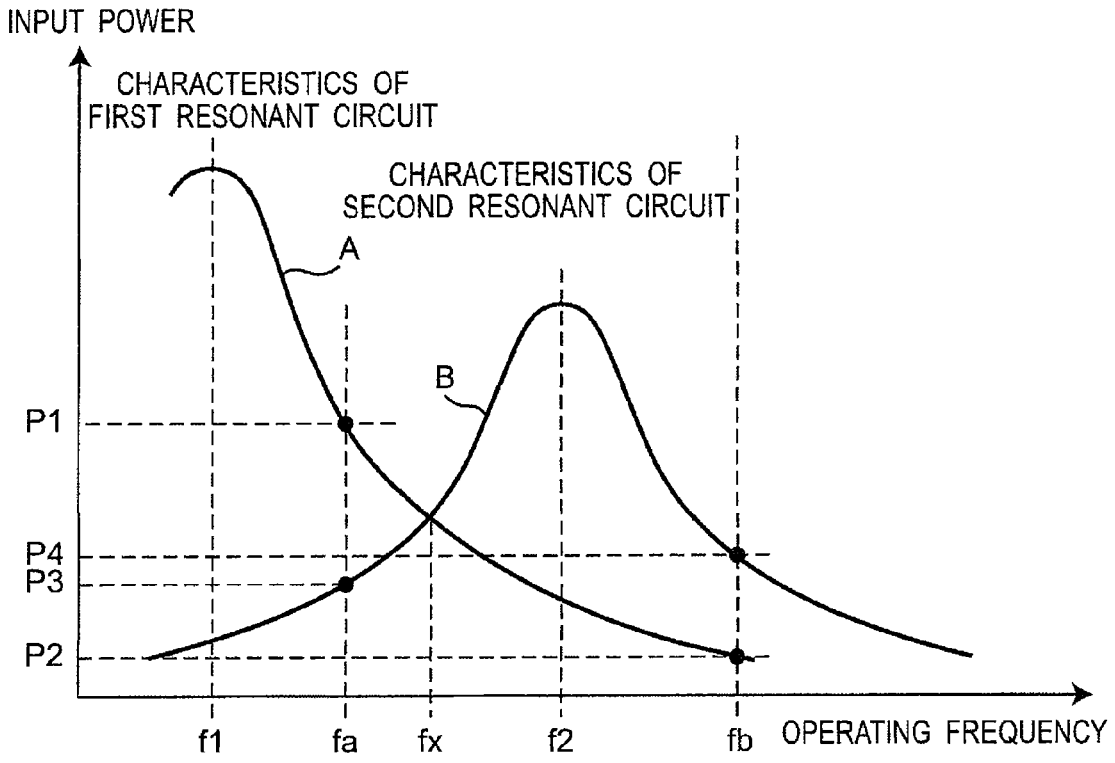
FIG. 2 is a graph showing a frequency characteristic of an inverter in the induction heating cooker of the first embodiment.

FIG. 2 is a graph showing the frequency characteristic of the inverter 4 in the induction heating cooker of the first embodiment, in which its horizontal axis denotes the operating frequency of the inverter 4 and its vertical axis denotes an input power to the heating coils 6 and 7. In FIG. 2, a characteristic curve A denotes the first frequency characteristic of a power input to the first heating coil 6 and a characteristic curve B denotes the second frequency characteristic of the power input to the second heating coil 7 in condition where the load such as the pan is placed.

As shown in FIG. 2, the power input from the inverter 4 to the heating coils 6 and 7 is maximized at resonant frequencies (f1 and f2) and gradually decreases as the operating frequencies (for example, fa and fb) of the semiconductor switches 9 and 10 in the inverter 4 separate from the resonant frequencies (f1 and f2) respectively. Therefore, it can be understood that by changing the operating frequencies (fa and fb), the power input to the heating coils 6 and 7 can be controlled.

Figure 3A:
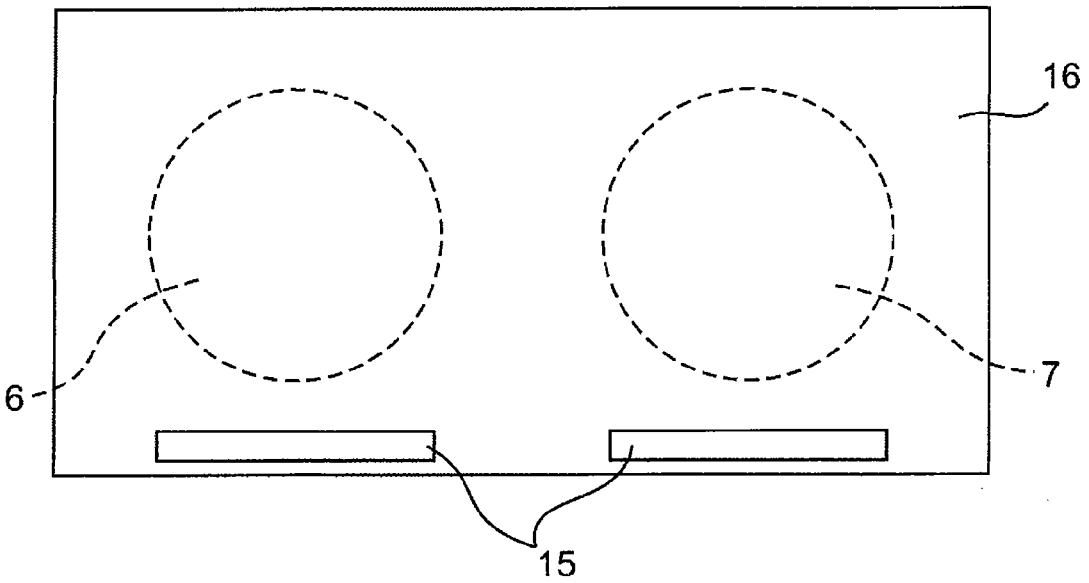
FIG. 3A is a plan view showing an external configuration of the induction heating cooker of the first embodiment.
Figure 3B:
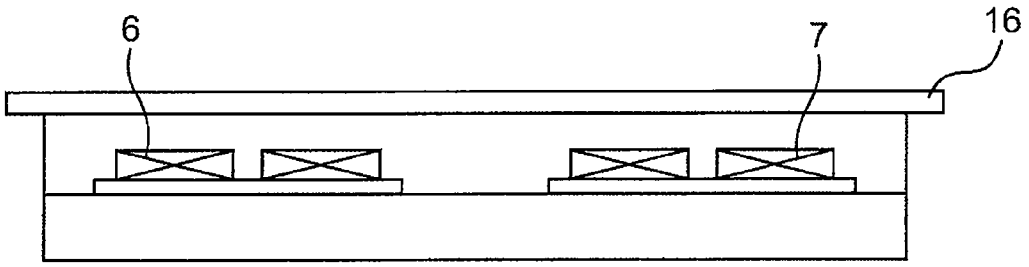
FIG. 3B is a cross-sectional view showing an outlined internal configuration of the induction heating cooker of the first embodiment.

FIG. 3A is a plan view showing an external configuration of the induction heating cooker of the first embodiment according to the present invention and FIG. 3B is a cross-sectional view showing an outlined internal configuration of the induction heating cooker of the first embodiment.

As shown in FIGS. 3A and 3B, in the induction heating cooker of the first embodiment, below a plate-shaped top plate 16 made of crystallized glass, the first heating coil 6 and the second heating coil 7 are disposed. On the top plate 16 above the first heating coil 6 and the second heating coil 7, the loads are placed as to-be-heated objects which have the different materials and shapes. On the side of the operator of the top plate 16, an operation display portion 15 is mounted. The induction heating cooker of the first embodiment is configured so that a desired power may be supplied to the respective heating coils 6 and 7 in accordance with the user operations on the operation display portion 15.

In the induction heating cooker of the first embodiment, the first heating coil 6 and the second heating coil 7 are connected to the inverter 4, and the inverter 4 is controlled by the turn-on/-off operations of the pair of semiconductor switches 9 and 10 as the semiconductor switch circuit. That is, the first heating coil 6 and the second heating coil 7 are driven by the same operating frequency and supplied with a power simultaneously.

The induction heating cooker of the first embodiment has the first frequency characteristic A (refer to FIG. 2) of a first resonant circuit 17 (refer to FIG. 1) including the first heating coil 6 and the first resonant capacitor 11 and the second frequency characteristic B (refer to FIG. 2) of a second resonant circuit 18 (refer to FIG. 1) including the second heating coil 7 and the second resonant capacitor 12 as shown in FIG. 2. The first frequency characteristic A and the second frequency characteristic B in the induction heating cooker of the first embodiment are set so that their respective resonant frequencies (f1, f2) may be shifted from each other by a predetermined frequency. Therefore, the first frequency characteristic A and the second frequency characteristic B have the different characteristic curves, so that by controlling the first semiconductor switch 9 and the second semiconductor switch 10 at a predetermined operating frequency, the different powers can be supplied to the first heating coil 6 and the second heating coil 7.

As shown in FIG. 2, in the induction heating cooker of the first embodiment, the first resonant frequency (f1) of the first frequency characteristic A is set lower than the second resonant frequency (f2) of the second frequency characteristic B, the first frequency characteristic A and the second frequency characteristic B are made different from each other. The first semiconductor switch 9 and the second semiconductor switch 10 in the inverter 4 are controlled by switching the two operating frequencies (fa, fb) from each other in every predetermined lapse of time.

The first operating frequency (fa) is set in a range between the first resonant frequency (f1) and the second resonant frequency (f2), while the second operating frequency (fb) is set in a range higher than the second resonant frequency (f2).

As shown in FIG. 2, at the first operating frequency (fa), a power (P1) is input to the first heating coil 6 to inductively heat the first load on the first heating coil 6, while simultaneously a power (P3) is input to the second heating coil 7 to inductively heat the second load on the second heating coil 7.

At the second operating frequency (fb), a power (P2) is input to the first heating coil 6 to inductively heat the first load on the first heating coil 6, while simultaneously a power (P4) is input to the second heating coil 7 to inductively heat the second load on the second heating coil 7.

Figure 4:
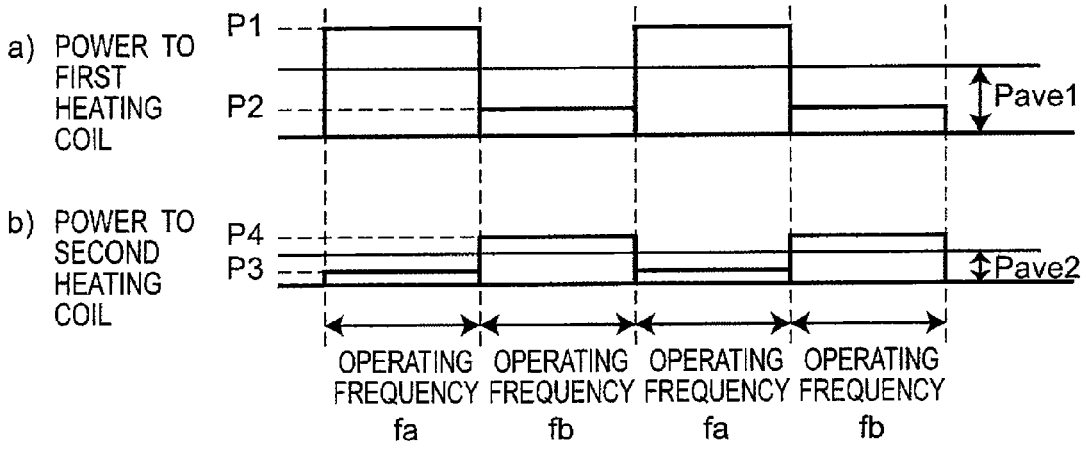
FIG. 4 is a schematic diagram showing time-wise changes of power input to the respective heating coils in the induction heating cooker of the first embodiment.

In FIG. 4, (a) schematically shows a time-wise change of a power input to the first heating coil 6 and (b) schematically shows a time-wise change of a power input to the second heating coil 7. As shown in FIG. 4, the first heating coil 6 and the second heating coil 7 are alternately controlled by using the respective two operating frequencies (fa and fb) from the inverter 4 in every predetermined lapse of time, so that the first heating coil 6 and the second heating coil 7 are supplied with the different amount of power. Therefore, the input powers to the respective heating coils 6 and 7 are of different values denoted by average powers (Pave 1, Pave2) in FIG. 4.

As described above, by alternately using the two operating frequencies (fa, fb) on the first semiconductor switch 9 and the second semiconductor switch 10 in every predetermined period of time, the first heating coil 6 and the second heating coil 7 are supplied with the different powers. The first heating coil 6 is supplied with a sum of power values obtained by multiplying the power (P1) and the power (P2) by the respective operation lapse of times of the operating frequencies (fa and fb), while the second heating coil 7 is supplied with a sum of power values obtained by multiplying the power (P3) and the power (P4) by the respective operation lapse of times of the operating frequencies (fa and fb).

Therefore, in the induction heating cooker of the first embodiment, by combining a lapse of time for which the heating coils 6 and 7 are driven at their respective operating frequencies (fa and fb) and a lapse of time for which one of them is supplied with powers, it is possible to adjust the power supplied to the first heating coil 6 and the second heating coil 7.

Further, in the induction heating cooker of the first embodiment, by changing the operating frequencies (fa, fb) for the first semiconductor switch 9 and the second semiconductor switch 10 respectively, it is possible to adjust the power supplied to the first heating coil 6 and the second heating coil 7.

Furthermore, in the induction heating cooker of the first embodiment, the control portion 8 is configured to alternately turn on/off the first semiconductor switch 9 and the second switch 10 so that the inverter 4 may supply a desired power to the first heating coil 6 and the second heating coil 7. Therefore, in the induction heating apparatus of the first embodiment, the control portion 8 changes an on/off ratio (duty ratio) between the first semiconductor switch 9 and the second semiconductor switch 10, so that it is possible to change the power input to the first heating coil 6 and the second heating coil 7.

Figure 5:
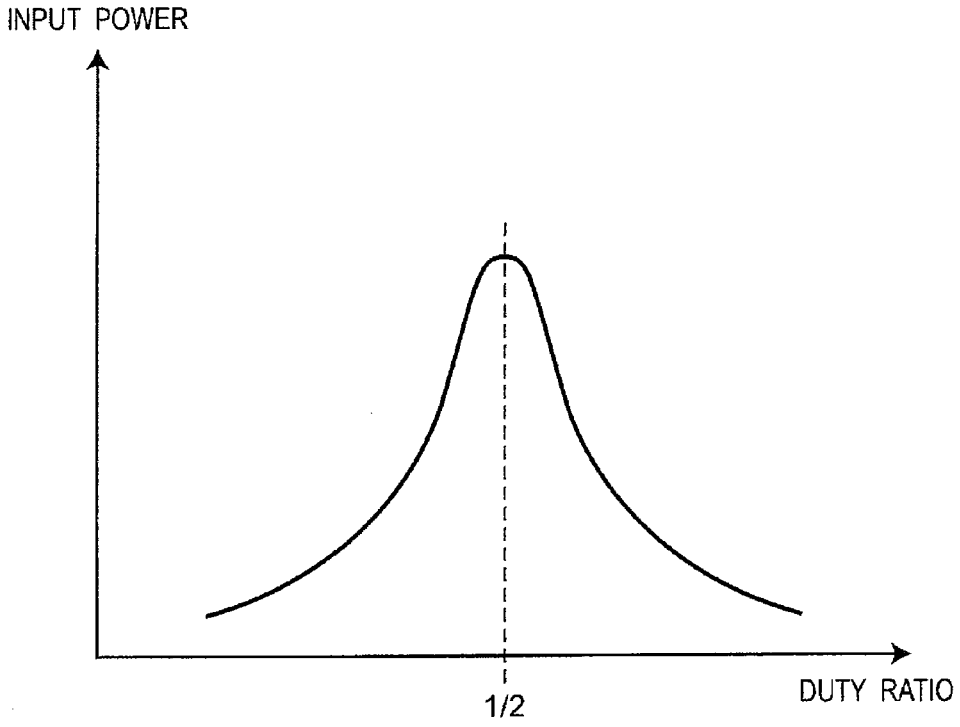
FIG. 5 is a graph showing a relationship between the input power to the heating coils and a duty ratio in turn-on/-off operations of semiconductor switches in the induction heating cooker of the first embodiment.

FIG. 5 is a characteristic curve showing a typical relationship between the duty ratio in turn-on/-off operations of the first semiconductor switch 9 and the second semiconductor switch 10 and the power input to the heating coils 6 and 7. As shown by the characteristic curve in FIG. 5, the input power is maximized when the duty ratio is ½, that is, the on-state period of time and the off-state period of time is equal to each other. Therefore, as the duty ratio shifts away from ½, the input power decreases. As a result, by changing the duty ratio after determining the operating frequencies of the first semiconductor switch 9 and the second semiconductor switch 10, it is possible to arbitrarily adjust the power supplied to the first heating coil 6 and the second heating coil 7.

[Operations of the Inverter in the Induction Heating Cooker of the First Embodiment]

Next, a description will be given of operations of the inverter in the induction heating cooker of the first embodiment. First, the operations will be described in the case of the first operating frequency (fa) on the frequency characteristic curves shown in FIG. 2.

Figure 6:
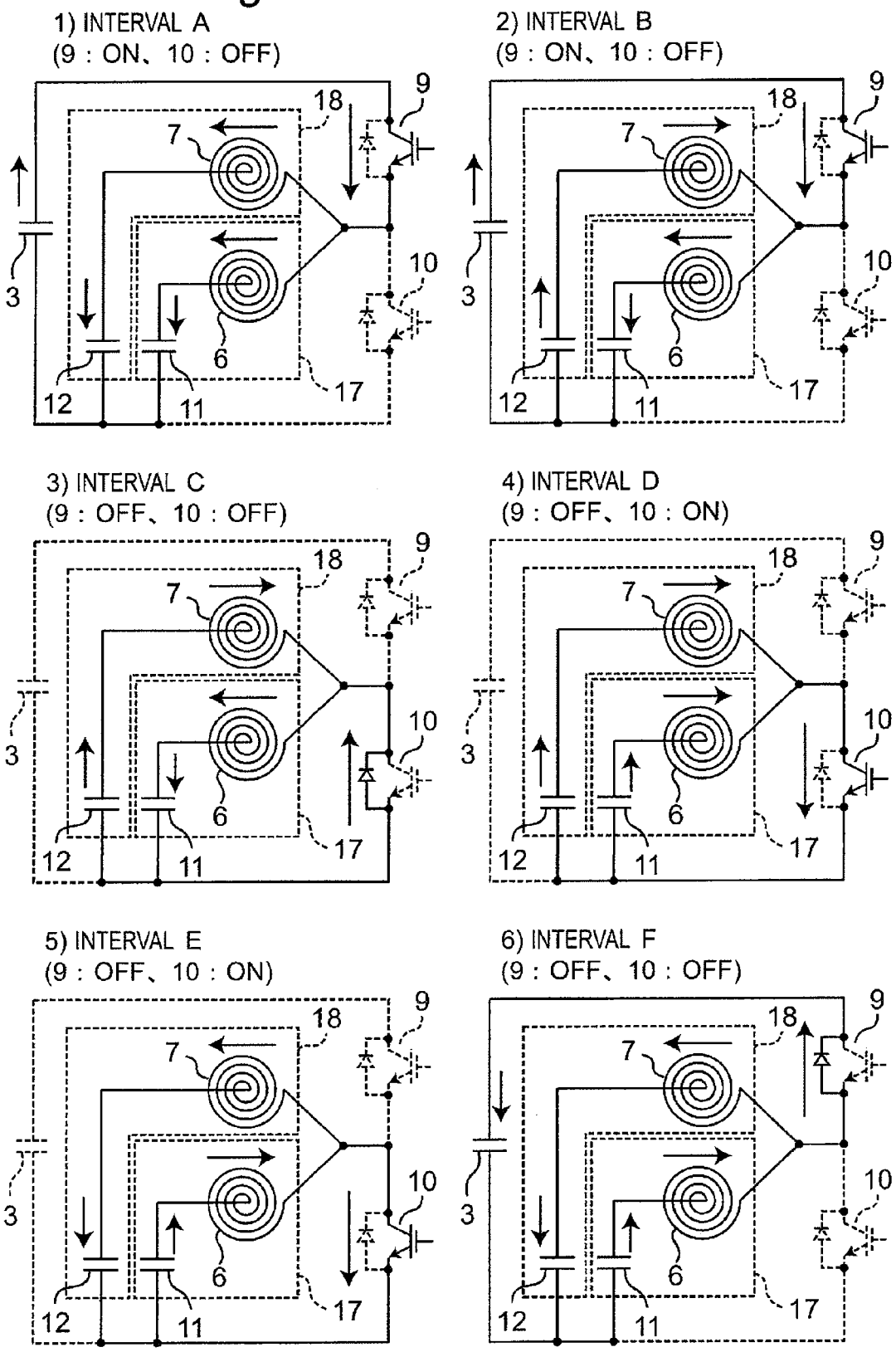
FIGS. 6(1)-6(6) are schematic diagrams showing operation states of an inverter circuit in its respective operation intervals when it is driven at a specific operating frequency in the induction heating cooker of the first embodiment.
Figure 7:
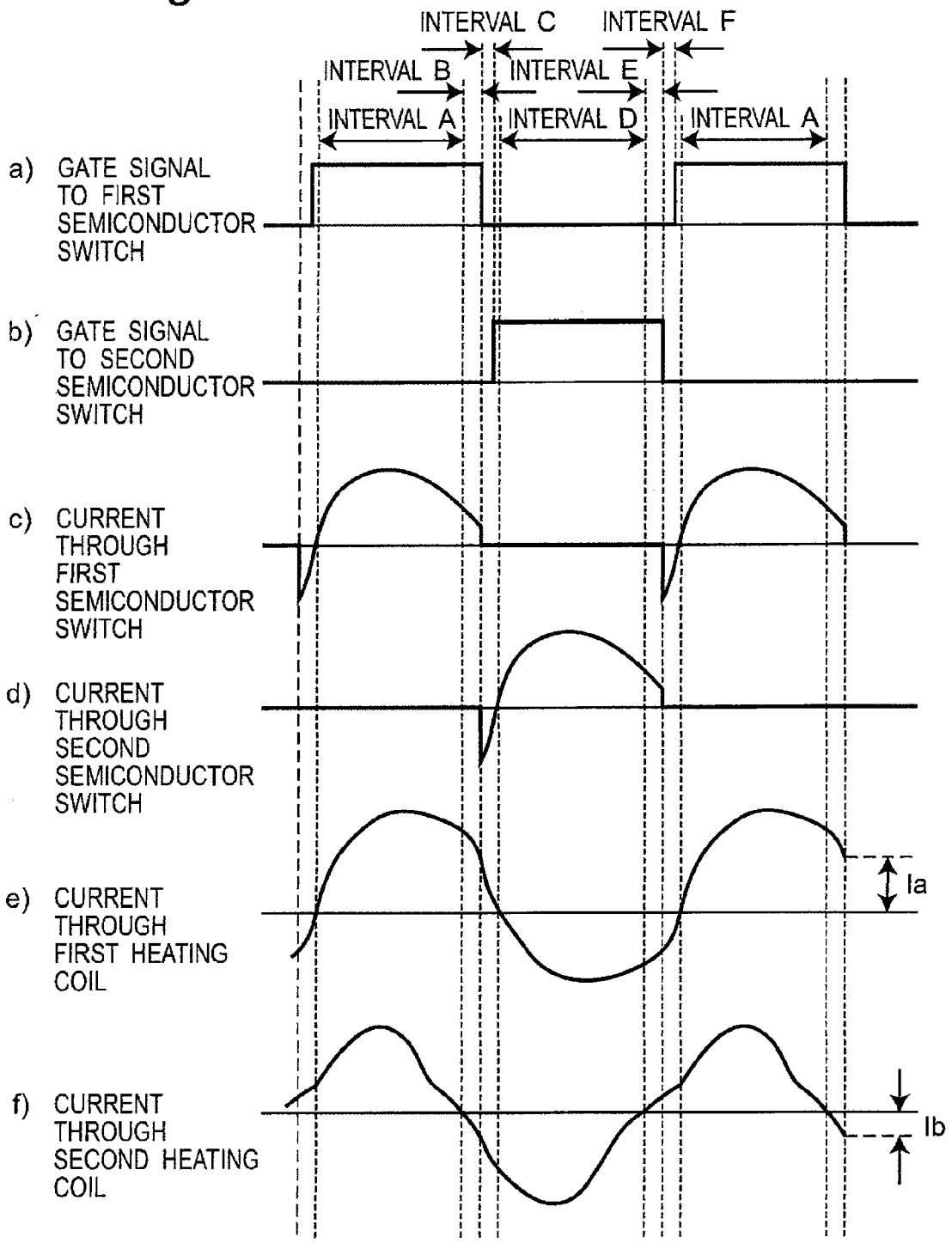
FIGS. 7(*a*)-7(*f*) are waveform charts showing waveforms of various units in the operation states shown in FIG. 6.

FIG. 6 are schematic diagrams showing operation states of an inverter circuit 4 in its respective operation intervals when the inverter circuit 4 is driven at the first operating frequency (fa) in the induction heating cooker of the first embodiment. FIG. 7 show waveforms at the respective portions in the operation states shown in FIG. 6. In FIG. 7, (a) shows the waveform of a gate signal to the first semiconductor switch 9 and (b) shows the waveform of the gate signal to the second semiconductor switch 10. (c) of FIG. 7 shows the waveform of a current flowing from the collector to the emitter of the first semiconductor switch 9 which enters the state of continuity (on-state) with the gate signal shown in (a) of FIG. 7, and (d) of FIG. 7 shows the waveform of a current flowing from the collector to the emitter of the second semiconductor switch 10 which enters the state of continuity (on-state) with the gate signal shown in (b) of FIG. 7, in which the direction in which the current flows from the collector to the emitter is denoted as the forward direction. (e) of FIG. 7 shows a current flowing through the first heating coil 6 and (f) of FIG. 7 shows a current flowing through the second heating coil 7.

"Ia" shown in (e) of FIG. 7 denotes the value of a current (wave height value) that flows through the first heating coil 6 when the first semiconductor switch 9 and the second semiconductor switch 10 are in the off-state. "Ib" shown in (f) of FIG. 7 denotes the value of a current (wave height value) that flows through the second heating coil 7 when the first semiconductor switch 9 and the second semiconductor switch 10 are in the off-state similarly.

[Definition of Intervals A to F at the First Operating Frequency (fa)]

An Interval A is a state in which the first semiconductor switch 9 is in the on-state (ON), the second semiconductor switch 10 is in the off-state (OFF), and a power is being supplied via the first semiconductor switch 9 to the first heating coil 6 and the second heating coil 7.

An Interval B is a state in which the first semiconductor switch 9 is in the on-state, the second semiconductor switch 10 is in the off-state, a current flowing through the second heating coil 7 is commuted into a direction opposite to that in the case of Interval A, and a power is being supplied via the first semiconductor switch 9 and the second heating coil 7 to the first heating coil 6.

An Interval C is a state in which the first semiconductor switch 9 is in the off-state, the second semiconductor switch 10 is in the off-state, and a current is flowing through the antiparallel diode in the second semiconductor switch 10.

An Interval D is a state in which the first semiconductor switch 9 is in the off-state, the second semiconductor switch 10 is in the on-state, and a power is being supplied via the second semiconductor switch 10 to the first heating coil 6 and the second heating coil 7.

An Interval E is a state in which the first semiconductor switch 9 is in the off-state, the second semiconductor switch 10 is in the on-state, a current flowing through the second heating coil 7 is commuted into a direction opposite to that in the case of Interval D, and a power is being supplied via the first semiconductor switch 9 and the second heating coil 7 to the first heating coil 6.

An Interval F is a state in which the first semiconductor switch 9 is in the off-state, the second semiconductor switch 10 is in the on-state, and a current is flowing through the antiparallel diode in the first semiconductor switch 9.

In an Interval from the end of the Interval C to the start of the Interval D, no current is flowing yet to the second semiconductor switch 10 despite that the second semiconductor switch 10 is in the on-state, so that the Interval D starts when a current starts flowing to the second semiconductor switch 10. Similarly, in an Interval from the end of the Interval F to the start of the Interval A, no current is flowing yet to the first semiconductor switch 9 despite that the first semiconductor switch 9 is in the on-state, so that the Interval A starts when a current starts flowing to the first semiconductor switch 9.

[Operations in Intervals A to F at the First Frequency (fa)]

Next, a description will be given of operations in the Intervals A to F at the first frequency (fa) with reference to FIGS. 6 and 7.

In the Interval A, the control portion 8 turns on the gate signal to the first semiconductor switch 9 and off the gate signal to the second semiconductor switch 10 to thereby supply a power from the smoothing capacitor 3 through the first semiconductor switch 9 to the first resonant circuit 17 including the first heating coil 6 and the first resonant capacitor 11 and the second resonant circuit 18 including the second heating coil 7 and the second resonant capacitor 12.

In the Interval B, the second resonant frequency (f2: refer to FIG. 2) is higher than the first operating frequency (fa), so that a flowing current is commuted in the second resonant circuit 18 including the second heating coil 7 and the second resonant capacitor 12. Accordingly, a current pathway is newly formed where the current flows through the second heating coil 7, the first heating coil 6, the first resonant capacitor 11, and the second resonant capacitor 12 in this order. This current pathway coexists with a current pathway where the current flows through the smoothing capacitor 3, the first semiconductor switch 9, the first heating coil 6, and the first resonant capacitor 11 in this order, so that a power is supplied to the first heating coil 6 and the second heating coil 7. That is, in the Interval B, the current flows through the first heating coil 6 in the same direction as that in the Interval A but flows through the second heating coil 7 in the opposite direction.

In the Interval C, the control portion 8 turns off the gate signal to the first semiconductor switch 9, to form a current pathway where a current flows through the first heating coil 6, the first resonant capacitor 11, and the antiparallel diode in the second semiconductor switch 10 in this order and a current pathway where a current flows through the second heating coil 7, the first heating coil 6, the first resonant capacitor 11, and the second resonant capacitor 12 in this order. The control portion 8 shifts to the Interval D by turning on the gate signal of the second semiconductor switch 10 in condition where the current is flowing through the antiparallel diode in the second semiconductor switch 10.

In the Interval D, the second semiconductor 10 is held in the on-state by the control portion 8, so that a current is commuted in the first resonant circuit 17 including the first heating coil 6 and the first resonant capacitor 11. Accordingly, a current pathway where a current flows through the first heating coil 6, the second semiconductor switch 10, and the first resonant capacitor 11 in this order and a current pathway where a current flows through the second heating coil 7, the second semiconductor switch 10, and the second resonant capacitor 12 in this order are formed, thereby supplying a power to the first heating coil 6 and the second heating coil 7.

In the Interval E, the second resonant frequency (f2: refer to FIG. 2) is higher than the first operating frequency (fa), so that a flowing current is commuted in the second resonant circuit 18 including the second heating coil 7 and the second resonant capacitor 12. Accordingly, a current pathway is newly formed where the current flows through the first heating coil 6, the second heating coil 7, the second resonant capacitor 12, and the first resonant capacitor 11 in this order. This current pathway coexists with a current pathway where the current flows through the first heating coil 6, the second semiconductor switch 10, and the first resonant capacitor 11 in this order, so that a power is supplied to the first heating coil 6 and the second heating coil 7. That is, in the Interval E, the current flows through the first heating coil 6 in the same direction as that in the Interval D but flows through the second heating coil 7 in the opposite direction.

In the Interval F, the control portion 8 turns off the gate signal of the second semiconductor switch 10, so as to form a current pathway where a current flows through the first heating coil 6, the antiparallel diode in the first semiconductor switch 9, the smoothing capacitor 3, and the first resonant capacitor 11 in this order and a current pathway where a current flows through the second heating coil 7, the second resonant capacitor 12, the first resonant capacitor 11, and the first heating coil 6 in this order. The control portion 8 shifts to the above-described the Interval A by turning on the gate signal of the first semiconductor switch 9 in condition where the current is flowing through the antiparallel diode in the first semiconductor switch 9. As hereinabove described, the operations in the Intervals A to F shown in FIG. 6 are carried over by control conducted by the control portion 8.

In the series of operations in the above the Intervals A to F, when the shift is made from the Interval B to the Interval C, that is, at timing when the first semiconductor switch 9 shifts from the on-state to the off-state, if the value of a current (Ib in FIG. 7) flowing through the second heating coil 7 is larger than the value of a current (Ia in FIG. 7) flowing through the first heating coil 6 (Ib>Ia), a current pathway occurs where the current flows through the second heating coil 7, the antiparallel diode in the first semiconductor switch 9, the smoothing capacitor 3, and the second resonant capacitor 12 in this order. In this state, no current flows through the antiparallel diode in the second semiconductor switch 10, to give rise to a difference in potential between the collector and the emitter of the second semiconductor switch 10. In the case of making the shift from the Interval C to the Interval D in condition where a difference in potential is present between the collector and the emitter of the second semiconductor switch 10 in such a manner, the operation is performed to change the second semiconductor switch 10 from the off-state to the on-state, difference in potential at the second semiconductor switch 10 is short-circuited. As a result, turn-on losses increase at the second semiconductor switch 10, thereby increasing the occurrence of noise. In particular, in a case where the snubber capacitors 13 and 14 (refer to FIG. 1) are connected between the collector and the emitter of the second semiconductor switch 10, charge accumulated in the snubber capacitors 13 and 14 are released through short-circuiting. Therefore, the losses and noise occurrence on the respective semiconductor switches become significantly large.

The problem at the time of the shift from the Interval B to the Interval C holds true also with the shift from the Interval E to the Interval F. That is, the problem occurs similarly also at the timing when the second semiconductor switch 10 is changed from the on-state to the off-state.

Accordingly, by setting the operating frequency of the inverter 4 in a range where the value of the current (Ia in FIG. 7) flowing through the first heating coil 6 is larger than the value of the current (Ib in FIG. 7) flowing through the second heating coil 7 (Ia>Ib), those short-circuiting operations can be avoided to perform stable operations with small losses and inhibited noise occurrence.

The operating frequency (fa) at which the value of the current (Ia) flowing through the first heating coil 6 is larger than the value of the current (Ib) flowing through the second heating coil 7 (Ia>Ib) roughly agrees with a frequency (fx) at which the frequency characteristic (A) of the first resonant circuit 17 and the frequency characteristic (B) of the second resonant circuit 18 as the functions of the input power shown in FIG. 2 intersect with each other. Therefore, the operating frequency (fa) can be realized by setting the operating frequency (fa) in a frequency range lower than the crossover frequency (fx) in the operations.

The magnitude relation between the current values (Ia and Ib) of the respective first and second heating coils 6 and 7 with respect to the operating frequency (fa) is determined by comparing those current values by using current detection means such as a current transformer to each of the heating coils 6 and 7. Further, the resonant characteristics of the resonant circuits can be predicted on the basis of the material of the pan, so that by providing resonant voltage detection means, which detects resonant voltages of the heating coils 6 and 7, in each of those heating coils 6 and 7, the material of the pan is determined on the basis of the detected resonant voltages to then set the operating frequency (fa) in its usable frequency range.

Next, a description will be given of the case of the second operating frequency (fb) on the frequency characteristic curves shown in FIG. 2.

Figure 8:
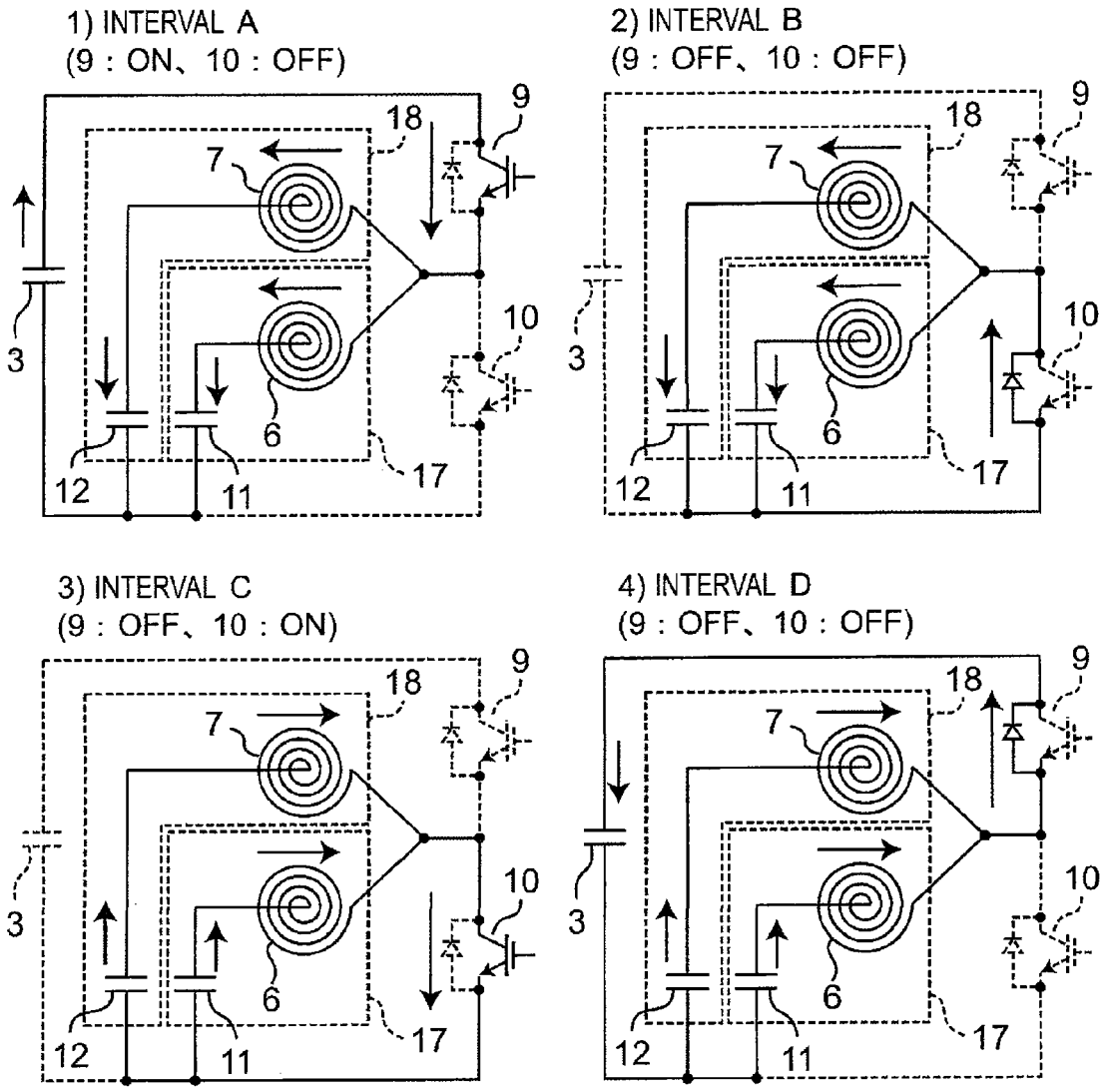
FIGS. 8(1)-8(4) are schematic diagrams showing operation states of an inverter circuit in its respective operation intervals when the inverter circuit is driven at a specific operating frequency in the induction heating cooker of the first embodiment.
Figure 9:
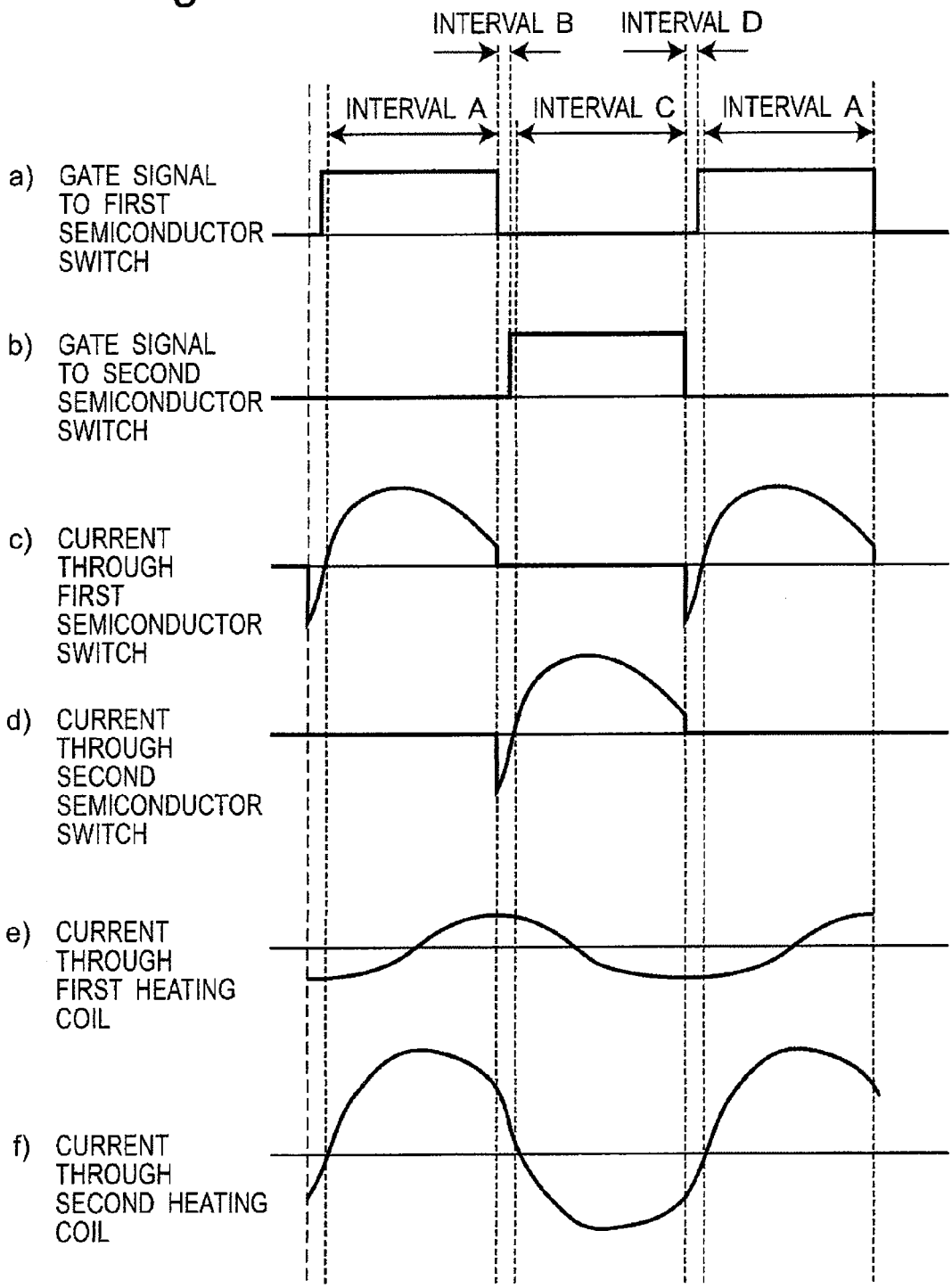
FIGS. 9(*a*)-9(*f*) are waveform charts showing the waveforms of the various units in the operation states shown in FIG. 8.

FIG. 8 are schematic diagrams showing operation states of the inverter circuit 4 in its respective operation intervals when it is controlled at the second operating frequency (fb) in the induction heating cooker of the first embodiment. FIG. 9 show waveforms at the respective portions in the operation states shown in FIG. 8. In FIG. 9, (a) shows the waveform of the gate signal to the first semiconductor switch 9 and (b) shows the waveform of the gate signal to the second semiconductor switch 10. (c) of FIG. 9 shows the waveform of a current flowing from the collector to the emitter of the first semiconductor switch 9 which enters the state of continuity (on-state) with the gate signal shown in (a) of FIG. 9, and (d) of FIG. 9 shows the waveform of a current flowing from the collector to the emitter of the second semiconductor switch 10 which enters the state of continuity (on-state) with the gate signal shown in (b) of FIG. 9, in which the direction in which the current flows from the collector to the emitter is denoted as the forward direction. (e) of FIG. 9 shows a current flowing through the first heating coil 6 and (f) of FIG. 9 shows a current flowing through the second heating coil 7.

In the first embodiment, the second operating frequency (fb) is set in a frequency range higher than the resonant frequency (f1) of the first resonant circuit 17 (which includes the first heating coil 6 and the first resonant capacitor 11) and the resonant frequency (f2) of the second resonant circuit 18 (which includes the second heating coil 7 and the second resonant capacitor 12. Therefore, no current commutation occurs in the heating coils 6 and 7 in contrast to the case of the first operating frequency (fa) (refer to FIG. 6). As a result, no turn-on loss occurs on the first semiconductor switch 9 and the second semiconductor switch 10, so that it is only necessary to select as the second operating frequency (fb) a frequency that is higher than the resonant frequency (f2) of the second resonant circuit 18 and that enables obtaining a predetermined power.

[Definition of Intervals A to D at the Second Operating Frequency (fb)]

The Interval A is a state in which the first semiconductor switch 9 is in the on-state (ON), the second semiconductor switch 10 is in the off-state (OFF), and a power is being supplied via the first semiconductor switch 9 to the first heating coil 6 and the second heating coil 7.

The Interval B is a state in which the first semiconductor switch 9 is in the off-state, the second semiconductor switch 10 is in the off-state, and a current is flowing through the antiparallel diode in the second semiconductor switch 10.

The Interval C is a state in which the first semiconductor switch 9 is in the off-state, the second semiconductor switch 10 is in the on-state, and a power is being supplied through the second semiconductor switch 10 to the first heating coil 6 and the second heating coil 7.

The Interval D is a state in which the first semiconductor switch 9 is in the off-state, the second semiconductor switch 10 is in the off-state, and a current is flowing through the antiparallel diode in the first semiconductor switch 9.

In an Interval from the end of the Interval B to the start of the Interval C, no current is flowing yet to the second semiconductor switch 10 despite that the second semiconductor switch 10 is in the on-state, so that the Interval C starts when a current starts flowing to the second semiconductor switch 10. Similarly, in an Interval from the end of the Interval D to the start of the Interval A, no current is flowing yet to the first semiconductor switch 9 despite that the first semiconductor switch 9 is in the on-state, so that the Interval A starts when a current starts flowing to the first semiconductor switch 9.

[Operations in Intervals A to D at the Second Frequency (fb)]

Next, a description will be given of operations in the Intervals A to D at the second frequency (fb) with reference to FIGS. 7 and 8.

In the Interval A, the control portion 8 turns on the gate signal of the first semiconductor switch 9 and off the gate signal of the second semiconductor switch 10 to thereby supply a power from the smoothing capacitor 3 through the first semiconductor switch 9 to the first resonant circuit 17 including the first heating coil 6 and the first resonant capacitor 11 and the second resonant circuit 18 including the second heating coil 7 and the second resonant capacitor 12.

In the Interval B, the control portion 8 turns off the gate signal of the first semiconductor switch 9 to thereby form a current pathway where a current flows through the first heating coil 6, the first resonant capacitor 11, and the antiparallel diode in the second semiconductor switch 10 in this order. Further, a current pathway is formed where a current flows through the second heating coil 7, the second resonant capacitor 12, and the antiparallel diode in the second semiconductor switch 10 in this order.

The control portion 8 shifts to the Interval C by turning on the gate signal to the second semiconductor switch 10 in condition where a current is flowing through the antiparallel diode in the second semiconductor switch 10.

In the Interval C, the control portion 8 turns on the gate signal of the second semiconductor switch 10 to form a current pathway where a current flows through the first heating coil 6, the second semiconductor switch 10, the first resonant capacitor 11 in this order and a current pathway where a current flows through the second heating coil 7, the second semiconductor switch 10, and the second resonant capacitor 12 in this order, thereby supplying a power to the first heating coil 6 and the second heating coil 7.

In the Interval D, the control portion 8 turns off the gate signal of the second semiconductor switch 10, to form a current pathway where a current flows through the first heating coil 6, the antiparallel diode in the first semiconductor switch 9, the smoothing capacitor 3, and the first resonant capacitor 11 in this order and a current pathway where a current flows through the second heating coil 7, the antiparallel diode in the first semiconductor switch 9, the smoothing capacitor 3, and the second resonant capacitor 12 in this order. The control portion 8 shifts to the above-described Interval A by turning on the gate signal of the first semiconductor switch 9 in condition where the current is flowing through the antiparallel diode in the first semiconductor switch 9. As hereinabove described, the operations in the Intervals A to D shown in FIG. 8 are repeated in accordance with control conducted by the control portion 8.

Next, a load such as a pan will be discussed which is inductively heated when the load is placed on the first heating coil 6 and the second heating coil 7 in the induction heating cooker of the first embodiment.

The load such as the pot which is inductively heated when the load is placed on the first heating coil 6 and the second heating coil 7 is made of a variety of materials. Therefore, the resonant characteristics in the induction heating cooker change with the electric characteristics of the load. As a result, the electric characteristics with respect to the operating frequency also change with the load.

Figure 10A:
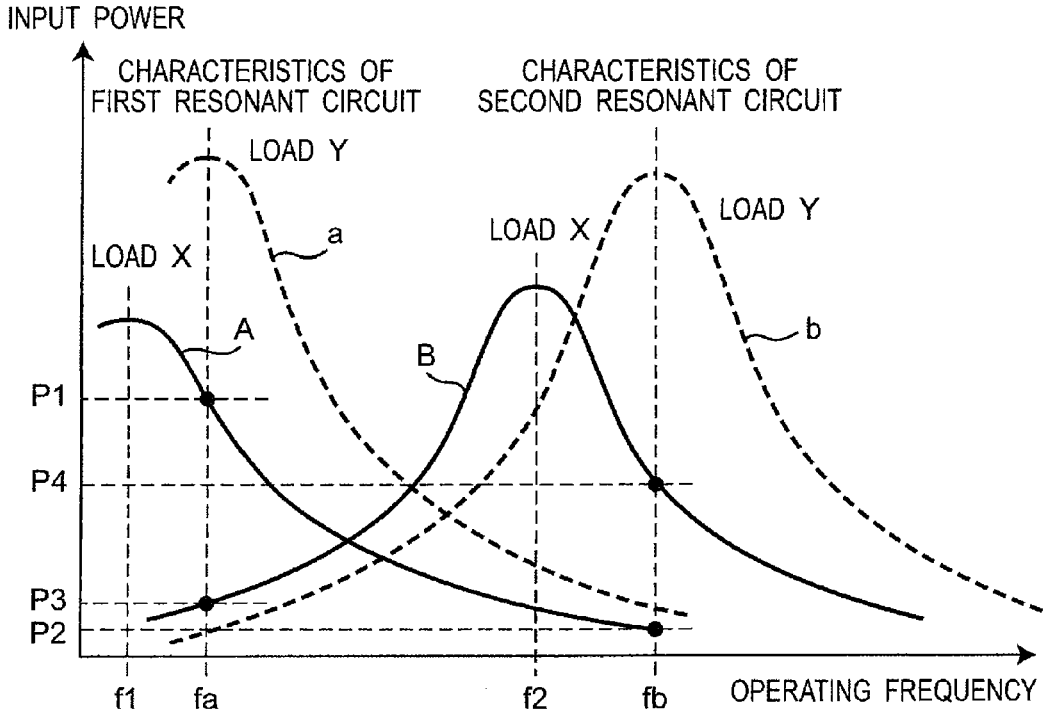
FIG. 10A is a graph showing a characteristic curve in a case where different loads are placed to the different heating coils in the induction heating cooker of the first embodiment.

In FIG. 10A, solid-line characteristic curves (A, B) show cases where a first load X is placed on the first heating coil 6 and the second heating coil 7. Further, broken-line characteristic curves (a, b) show cases where a second load Y is placed on the first heating coil 6 and the second heating coil 7. In FIG. 10A, its horizontal axis represents the operating frequency [kHz] and its vertical axis represents the input power [kW] to the heating coils 6 and 7.

As shown in FIG. 10A, as the first operating frequency (fa) on the low frequency side, a frequency is selected in such a range that the input power to the first heating coil 6 may be in a range larger than that to the second heating coil 7, and as the frequency increases, the input power to the first heating coil 6 may decrease and the input power to the second heating coil 7 may increase. Therefore, the first operating frequency (fa) is selected in a frequency range that is higher than at least the resonant frequency (f1) of the first resonant circuit 17 including the load and lower than at least the resonant frequency (f2) of the second resonant circuit 18 including the load.

In the second operating frequency (fb) on the high frequency side, an operating frequency is selected which is in a frequency range higher than the resonant frequency (f1) of the first resonant circuit 17 including the load and the resonant frequency (f2) of the second resonant circuit 18 including the load, and average powers of the respective heating coils 6 and 7 may be set values.

Figure 10B:
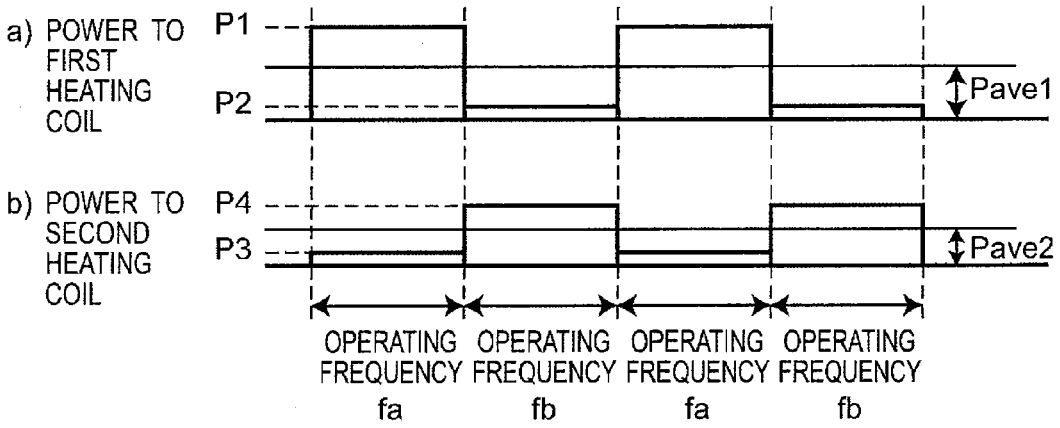
FIGS. 10B(a) and 10B(b) are schematic diagrams showing a fact that powers of the different operating frequencies are alternately supplied from the inverter to the different heating coils in every predetermined lapse of time along the characteristic curves in FIG. 10A.

(a) of FIG. 10B shows that powers (P1, P2) of the respective first operating frequency (fa) and second operating frequency (fb) are alternately supplied from the inverter 4 to the first heating coil 6 in every predetermined lapse of time. (b) of FIG. 10B shows that powers (P3, P4) of the respective first operating frequency (fa) and second operating frequency (fb) are alternately supplied from the inverter 4 to the second heating coil 7 in every predetermined lapse of time.

As shown in FIG. 10B, drive signals having the respective two operating frequencies (fa, fb) are alternately supplied from the inverter 4 to the first heating coil 6 and the second heating coil 7 in every predetermined lapse of time. As a result, the different powers are alternately input to the first heating coil 6 and the second heating coil 7, so that the first heating coil 6 and the second heating coil 7 have the different values of electric energy denoted by average powers (Pave1, Pave2) in FIG. 10B.

In a frequency characteristic graph in FIG. 10A, a broken-line frequency characteristic a shows a characteristic curve in a case where the second load Y is placed on the first heating coil 6, while a broken-line frequency characteristic b shows a characteristic curve in a case where the second load Y is placed on the second heating coil 7. Generally, the load having a relative permeability of nearly 1 such as nonmagnetic stainless steel has a higher resonant frequency than the load having a higher relative permeability such as magnetic stainless steel. Therefore, as the operating frequency at which the nonmagnetic metal load is heated, a frequency higher than that for the magnetic metal load is selected. In FIG. 10A, the first load X having the frequency characteristic curves A and B exemplifies the characteristic curve in the case of heating a load made of magnetic metal and the second load Y having the frequency characteristic curves a and b exemplifies the characteristic curve in the case of heating a load made of nonmagnetic metal.

Figure 11A:
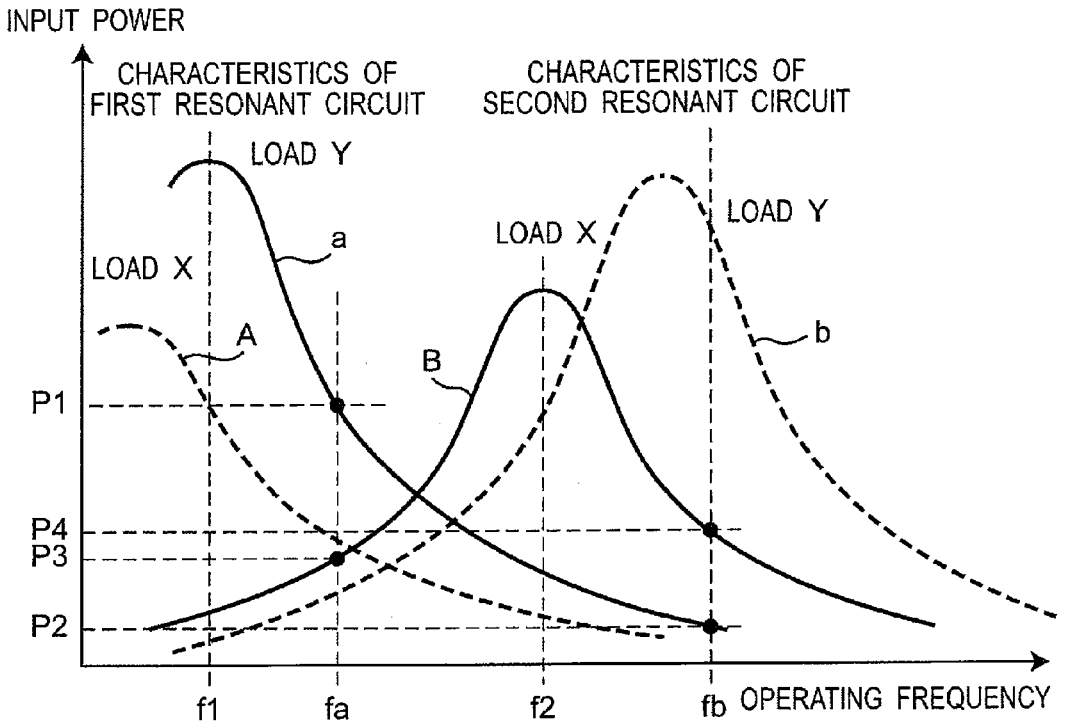
FIG. 11A is another graph showing the characteristic curve in a case where different loads are placed to the different heating coils in the induction heating cooker of the first embodiment.
Figure 11B:
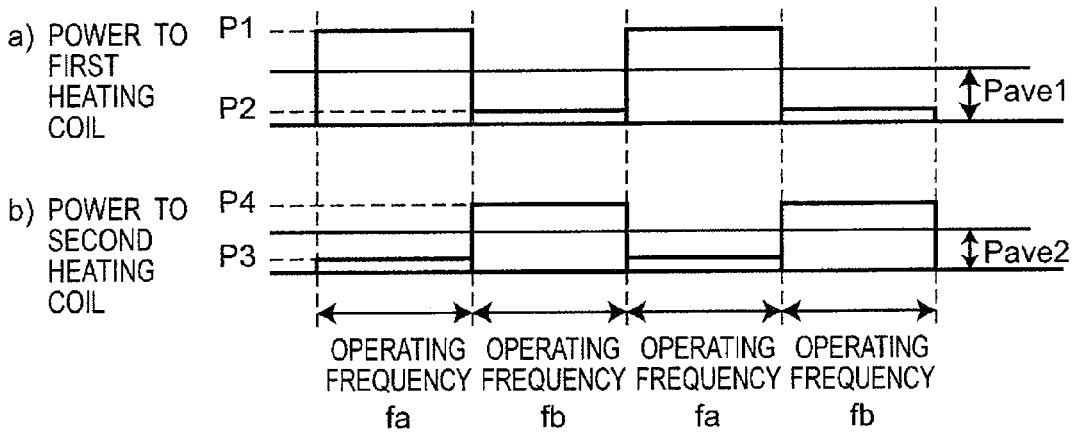
FIGS. 11B(a) and 11B(b) are other schematic diagrams showing the fact that powers of the different operating frequencies are alternately supplied from the inverter to the different heating coils in every predetermined lapse of time along the characteristic curves in FIG. 11A.

In FIG. 11A, a solid-line characteristic curve (a) shows a case where the second load Y is placed on the first heating coil 6 and a solid-line characteristic curve (B) shows a case where the first load X is placed on the second heating coil 7. As a reference, a broken-line characteristic curve (A) shows a case where the first load X is placed on the first heating coil 6 and a broken-line characteristic curve (b) shows a case where the second load Y is placed on the second heating coil 7. In FIG. 11A, its horizontal axis represents the operating frequency [kHz] and its vertical axis represents the input power [kW] to the heating coils 6 and 7.

On the frequency characteristic curves (a, B) shown by the solid lines in FIG. 11A, similar to the case of the frequency characteristic curves shown in FIG. 10A, the first operating frequency (fa) on the low frequency side will be selected as follows. That is, the first operating frequency (fa) is selected in such a range that the input power to the first heating coil 6 may be in a range larger than that to the second heating coil 7, and as the frequency increases, the input power to the first heating coil 6 may decrease and the input power to the second heating coil 7 may increase.

In the second operating frequency (fb) on the high frequency side, a frequency is selected which is in a frequency range higher than the resonant frequencies (f1, f2) of the first resonant circuit 17 and the second resonant circuit 18, and average powers (Pave1, Pave2) of the respective heating coils 6 and 7 may be set values.

As described above, the load having a relative permeability of nearly 1 such as nonmagnetic stainless steel has a higher resonant frequency than the load having a higher relative permeability such as magnetic stainless steel, so that as the operating frequency at which the nonmagnetic metal load is heated, a frequency higher than that of the magnetic metal load is selected.

As described above, in the induction heating cooker of the first embodiment, by selecting the operating frequency in accordance with the resonant frequency of the resonant circuit which changes with the load, it is possible to generate heat at the respective heating coils by using a desired power without changing the power characteristic relation between the resonant circuits. Therefore, in the induction heating cooker of the first embodiment, each of the heating coils can give stable heating in condition where circuit losses and noise occurrence are suppressed.

To decide the material of the load such as a pan that is an object to be heated, electric characteristics can be detected and judged such as an operating frequency of the inverter 4, an input current, a current flowing through the heating coils, and a resonant voltage of the heating coils. Although not specified in particular in the description, the first embodiment of the present invention gives a configuration having any decision means.

Although the first embodiment has been described with reference to the example where a two-IC half-bridge circuit would be used as the inverter 4, the present invention is not limited to thereto; for example, a four-IC full-bridge circuit may be used as long as the same semiconductor switch is connected with a couple of pluralities of heating coils and resonant capacitors having the different resonant frequencies.

In the induction heating cooker of the first embodiment, the first heating coil 6 and the second heating coil 7 operate at the same frequency always, so that a preferable feature is obtained in that no difference in frequency occurs between the heating coils with no interference sound.

Moreover, although the induction heating cooker of the first embodiment has been described with the case of the two resonant circuits 17 and 18 including the heating coils 6 and 7 and the resonant capacitors 11 and 12 respectively, almost the same effects can be obtained even in the case where the three resonant circuits are provided as long as the resonant frequency with any load on the low frequency side can be set higher than that with no load on the high frequency side between the heating coils having the equivalent resonant characteristics adjacent to each other.

As hereinabove described, in the induction heating cooker of the first embodiment according to the present invention, a plurality of resonant circuits each of which includes a heating coil inductively heating a load and a resonant capacitor are connected to an inverter which includes a couple of semiconductor switches connected to a power supply circuit, and the pair of semiconductor switches may be turned on/off to supply a power from the inverter to the plurality of heating coils. Further, in the induction heating cooker of the first embodiment, by changing the respective resonant frequencies of the plurality of resonant circuits and alternately switching the operating frequencies of the respective semiconductor switches to drive them in every predetermined lapse of time, the powers supplied to the respective heating coils can be adjusted. Accordingly, by the configuration of the first embodiment, it is possible to realize a small and inexpensive induction heating apparatus having few components and a small circuit mounting area.

Second Embodiment

Figure 12:
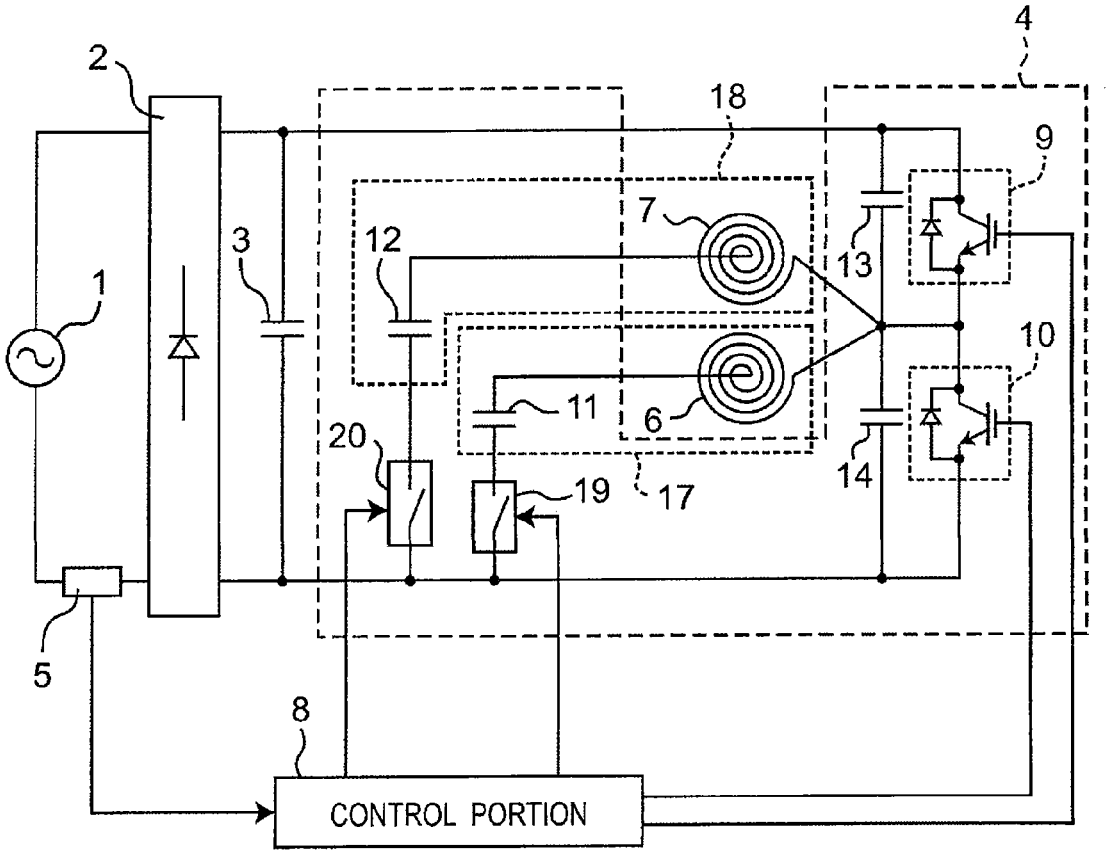
FIG. 12 is a schematic diagram showing a configuration of the induction heating cooker of a second embodiment according to the present invention.

Next, a description will be given of an induction heating cooker as one example of the induction heating apparatus of a second embodiment according to the present invention with reference to the accompanying drawings. FIG. 12 is a schematic diagram showing a configuration of the induction heating cooker of the second embodiment.

The configuration of the second embodiment is different from that of the first embodiment in that a first switching portion 19 is serially connected to a first resonant circuit 17 including a first heating coil 6 and a first resonant capacitor 11 and a second switching portion 20 is serially connected to a second heating coil 7 and a second resonant capacitor 12. The other components are the same as those of the first embodiment, so that in the description of the second embodiment, identical reference numerals are given to components including the identical function and structure in the induction heating cooker of the first embodiment, and the description of the first embodiment is applied to the second embodiment.

A description will be given of operations in the induction heating cooker of the second embodiment. Similar to the induction heating cooker of the first embodiment, the induction heating cooker of the second embodiment has a plurality of heating coils so that a plurality of loads can be inductively heated simultaneously. Therefore, in the case of inductively heating a load placed on only one of the heating coils, it is preferable to operate only the relevant heating coil. For this purpose, in the inductive heating cooker of the second embodiment, the switching portions 19 and 20 are mounted to enable selecting any one of the heating coils to be operated for inductive heating.

In the induction heating cooker of the second embodiment, if the load such as a pan is placed on the heating coils and any one of heating coils to be operated for induction heating is selected, a control portion 8 operates the first switching portion 19 and/or the second switching portion 20 to excite the resonant circuits 17 and 18 including the heating coils 6 and 7 respectively, thereby starting induction heating. Further, if a command to start heating is given in condition where no load is placed, the control portion 8 puts the first switching portion 19 and/or the second switching portion 20 into the state of non-continuity (off-state) at a point in time when the control portion 8 detects no load being mounted.

As described above, the induction heating cooker of the second embodiment has the configuration in which the switching portions 19 and 20 are added to the resonant circuits 17 and 18 respectively, thereby enabling standalone heating by either the heating coil 6 or 7 efficiently and securely. In the induction heating cooker of the second embodiment, although the switching portions 19 and 20 are each configured by switching means such as a relay or a semiconductor switch, the present invention is not limited to thereto in particular.

By performing switching by the switching portions 19 and 20 in condition where the inverter 4 is stopped, it is possible to reduce stress at the time of switching. In particular, if a magnetic relay is used as the switching means, it is preferable to perform switching after stopping the inverter 4 from the viewpoint of endurance of a contact at the time of switching.

In a case where the first heating coil 6 and the second heating coil 7 perform heating simultaneously, after the first switching portion 19 and the second switching portion 20 are put into the state of continuity, the same heating operations as those in the first embodiment are performed.

As hereinabove described, in the induction heating cooker of the second embodiment according to the present invention, by fitting the switching portions 19 and 20 to the resonant circuits 17 and 18 including the heating coils 6 and 7 as well as the resonant capacitors 11 and 12 respectively, any one of the heating coils 6 and 7 can perform heating alone. Accordingly, in the configuration of the second embodiment, it is possible to operate only the required one of the heating coils, thereby realizing an easy-to-use induction heating apparatus.

Third Embodiment

Figure 13:
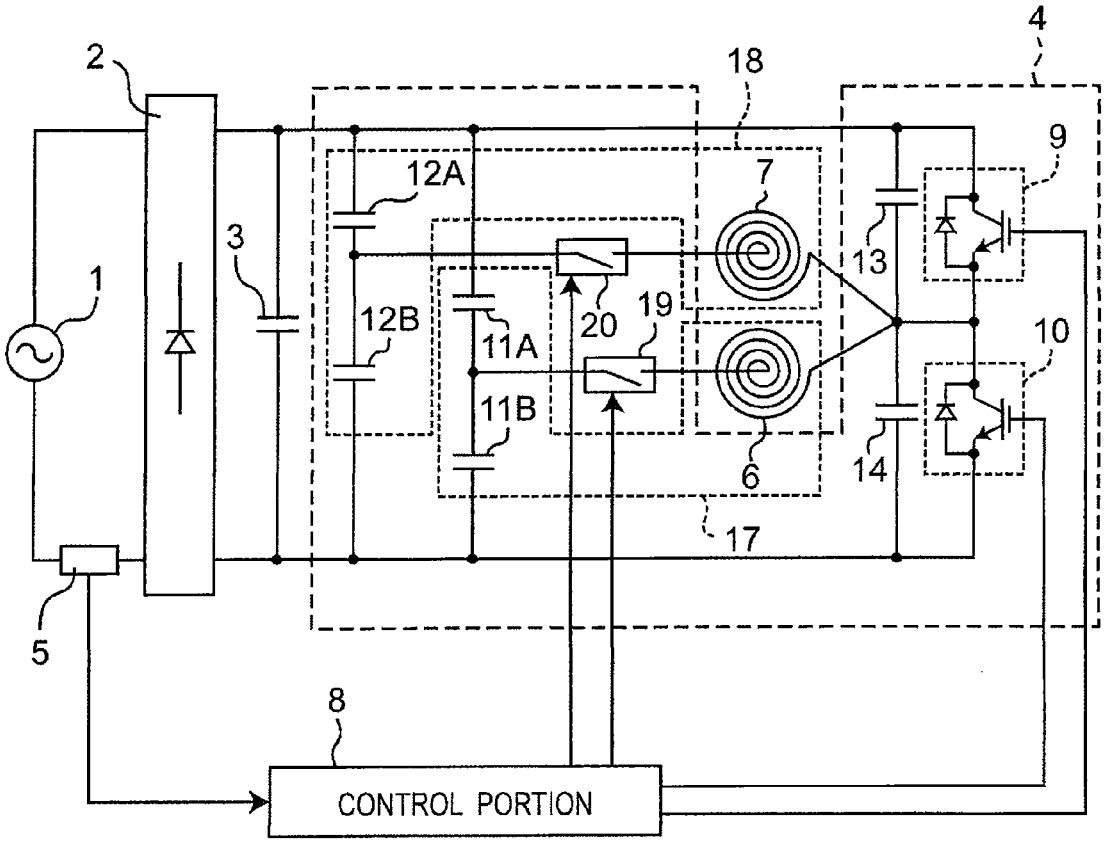
FIG. 13 is a schematic diagram showing a configuration of the induction heating cooker of a third embodiment according to the present invention.

Next, a description will be given of an induction heating cooker as one example of the induction heating apparatus of a third embodiment according to the present invention with reference to the accompanying drawings. FIG. 13 is a schematic diagram showing a configuration of the induction heating cooker of the third embodiment.

The configuration of the third embodiment is different from that of the first embodiment in that first resonant capacitors 11A and 11B to be connected to a first heating coil 6 and second resonant capacitors 12A and 12B to be connected to a second heating coil 7 are divided in plural so that they may configure the respective series circuits. Further, in the third embodiment, the series circuit including the first resonant capacitors 11A and 11B and the series circuit including the second resonant capacitors 12A and 12B are each connected to a smoothing capacitor 3 in parallel. Moreover, between a connecting point of the series circuit including the first resonant capacitors 11A and 11B and a node between a first semiconductor switch 9 and a second semiconductor switch 10, a series circuit including the first heating coil 6 and a first switching portion 19 is connected. Similarly, between a connecting point of the series circuit including the second resonant capacitors 12A and 12B and the node between the first semiconductor switch 9 and the second semiconductor switch 10, a series circuit including the second heating coil 7 and a second switching portion 20 is connected. The other components are the same as those of the first embodiment, so that in the description of the third embodiment, identical reference numerals are given to components including the identical function and structure in the induction heating cooker of the first embodiment, and the description of the first embodiment is applied to the third embodiment.

A description will be given of operations in the induction heating cooker of the third embodiment. Similar to the induction heating cooker of the first embodiment, the induction heating cooker of the third embodiment has a configuration that a plurality of loads can be inductively heated simultaneously and only selected one of the plurality of heating coils can perform heating. In the case of inductively heating the load placed on only one of the heating coils, it is preferable to operate only the relevant heating coil. For this purpose, in the inductive heating cooker of the third embodiment, the switching portions 19 and 20 are mounted to enable selecting any one of the heating coils to be operated for inductive heating.

In the induction heating cooker of the third embodiment, if the load such as a pan is placed on the heating coils and any one of heating coils to be operated for induction heating is selected, a control portion 8 operates the first switching portion 19 and/or the second switching portion 20 to excite the resonant circuits 17 and 18 including the heating coils 6 and 7 respectively, thereby starting induction heating. Further, if a command to start heating is given in condition where no load is placed, the control portion 8 puts the first switching portion 19 and/or the second switching portion 20 into the state of non-continuity (off-state) at a point in time when the control portion 8 detects no load being placed.

In the induction heating cooker of the third embodiment, although the switching portions 19 and 20 are each configured by a relay or a semiconductor switch, the present invention is not limited to thereto in particular. By performing switching by the switching portions 19 and 20 in condition where the inverter 4 is stopped, it is possible to reduce stress at the time of switching. It is preferable to use a magnetic relay as the switching portions 19 and 20 from the viewpoint of endurance of a contact, taking into account the stress at the time of switching.

In the induction heating cooker of the third embodiment, if the load such as a pan is placed thereon and the first heating coil 6 is selected, the first resonant capacitors 11A and 11B and the first heating coil 6 are connected to form the first resonant circuit 17. In this state, the second resonant capacitors 12A and 12B are separated from the second heating coil 7 and connected in parallel with the smoothing capacitor 3. Therefore, the second resonant capacitors 12A and 12B act as a smoothing capacitor along with the smoothing capacitor 3. In particular, in the case of heating by standalone heating coil, specifications with a large maximum power may possibly have a large ripple current in a configuration having only the smoothing capacitor 3. Therefore, in the configuration of the third embodiment, a capacitance of other capacitors is added to the smoothing capacitor 3 to increase the capacitance of the smoothing capacitor, it is possible to reduce noise components and a rise in temperature of the smoothing capacitor 3.

In the configuration of the third embodiment, in the case of dividing the first resonant capacitors 11A and 11B and the second resonant capacitors 12A and 12B respectively, the subdivided capacitors should preferably have the same capacitance. In a case where the first semiconductor switch 9 and the second semiconductor switch 10 are operating in the same conduction time, the same current flows through the first semiconductor switch 9 and the second semiconductor switch 10, so that a bias in loss can be prevented between semiconductor switch 9 and the second semiconductor switch 10 and also between the first resonant capacitors 11A and 11B and the second resonant capacitors 12A and 12B because the same current flows through them.

As hereinabove described, the induction heating of the third embodiment according to the present invention has a configuration in which resonant capacitors 11A and 11B and the second resonant capacitors 12A and 12B are divided and serially connected, and then connected in parallel with the smoothing capacitor 3 respectively. Further, in the third embodiment, between the connecting points of the series circuits including the first resonant capacitors 11A and 11B and the second resonant capacitors 12A and 12B and the node between the first semiconductor switch 9 and the second semiconductor switch 10, the first heating coil 6 and the first switching portion 19 and the second heating coil 7 and the second switching portion 20 are connected respectively. In the induction heating cooker of the third embodiment having such a configuration, in a case where only one of the heating coils is used, the resonant capacitors on the side out of use can function as a smoothing capacitor to reduce a ripple current on the smoothing capacitors. As a result, by the configuration of the third embodiment, it is possible to provide an induction heating cooker with less noise.

Almost the same effects as those by the first embodiment can be obtained by providing none of the switching portions 19 and 20 in the configuration of the third embodiment. That is, the first resonant capacitor and the second resonant capacitor are divided in plural to form series circuits, and the series circuits including the first resonant capacitors 11A and 11B and the second resonant capacitors 12A and 12B respectively are connected in parallel with the smoothing capacitor 3. Further, between the connecting point of the series circuit including the first resonant capacitors 11A and 11B and the node between the semiconductor switch 9 and the second semiconductor switch 10, the first heating coil 6 is connected. Similarly, between the connecting point of the series circuit including the second resonant capacitors 12A and 12B and the node between the semiconductor switch 9 and the second semiconductor switch 10, the second heating coil 7 is connected. In the induction heating cooker having such a configuration, similar to the case of the first embodiment, it is possible to enable the plurality of heating coils to perform heating efficiently and simultaneously by sharing the inverter in use and also securely adjust powers without increasing losses in the semiconductor switches with respect to the respective heating coils.

Fourth Embodiment

Next, a description will be given of an induction heating cooker as one example of the induction heating apparatus of a fourth embodiment according to the present invention with reference to the accompanying drawings. The induction heating cooker of the fourth embodiment is different from the first embodiment in terms of the range to set the operating frequencies controlled by the control portion. In the fourth embodiment, taking into account standalone heating by the heating coil, the operating frequency of the inverter is to be set in a specific range. Therefore, although the induction heating cooker of the fourth embodiment will be described with reference to the same configuration as that of the induction heating cooker of the first embodiment, the configuration of the second or third embodiment may be employed. In the description of the fourth embodiment, identical reference numerals are given to components including the identical function and structure the identical function and structure in the induction heating cooker of the first embodiment, and the description of the first embodiment is applied to the fourth embodiment.

Figure 14:
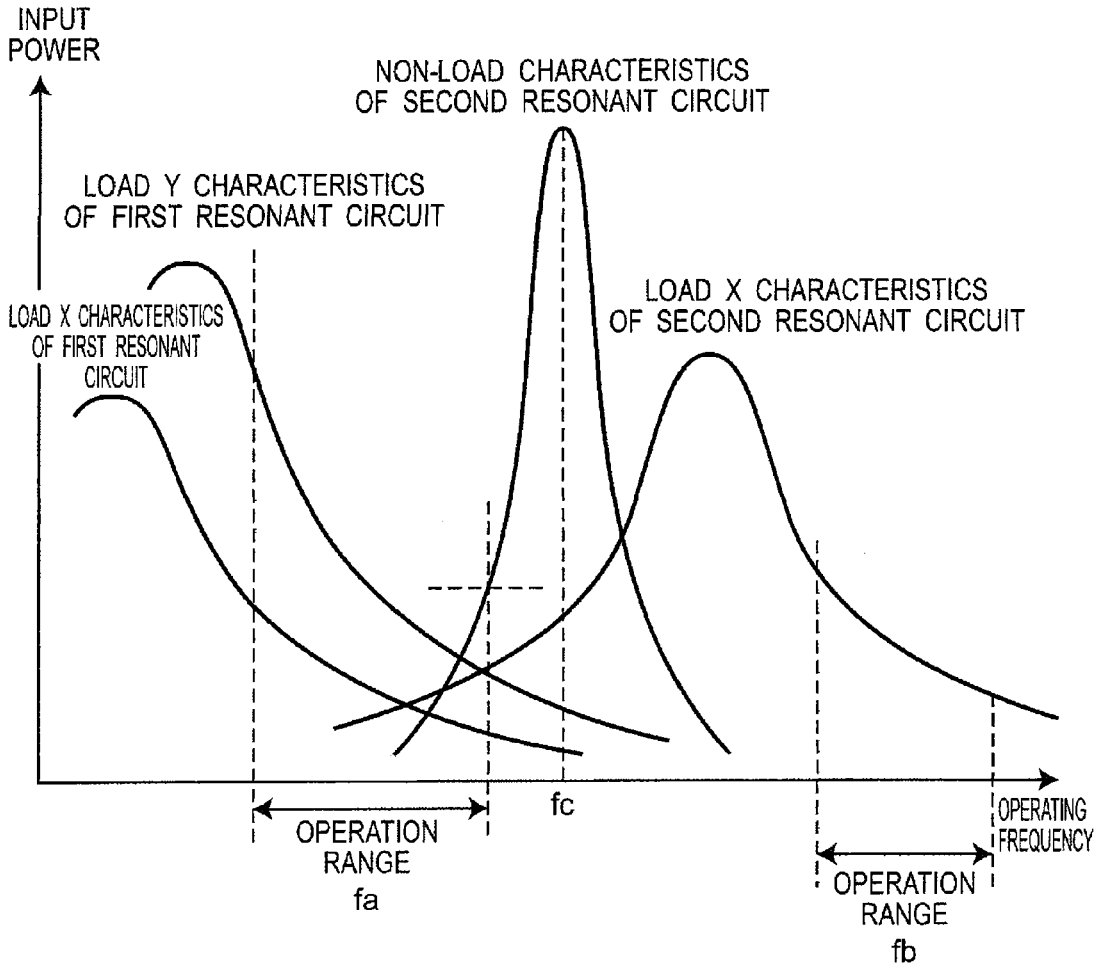
FIG. 14 is a graph showing changes in input power with respect to the operating frequency in the induction heating cooker of a fourth embodiment according to the present invention.

A description will be given of operations in the induction heating cooker of the fourth embodiment. FIG. 14 shows changes in input power with respect to the operating frequency similar to the frequency characteristic curves in FIG. 2 described in the first embodiment. FIG. 14 shows a case where a first load X or a second load Y is placed on a first heating coil 6. Further, FIG. 14 also shows a case where the first load X is placed on a second heating coil 7 and a case where no load is placed on the second heating coil 7.

Since the resonant frequency is determined by $\frac{1}{2}(2\pi\sqrt{(L\times C)})$, the inductance (L) is maximized at the time of no load where the load and the heating coil are not coupled. Accordingly, at the time of no load, the resonant frequency (fc) is minimized. As a result, a frequency characteristic curve of the input power in a case where various kinds of loads are placed on the first heating coil 6 may overlap with that in a case where no load is placed on the second heating coil 7. In particular, in a case where the load placed on the first heating coil 6 is made of nonmagnetic stainless steel, inductance is larger than that of the load made of a magnetic material, so that the resonant frequency tends to increase.

In a state where loads are placed on both of the first heating coil 6 and the second heating coil 7 and heated at an operating frequency in the vicinity of a resonant frequency (fc) of the second heating coil 7 at the time of no load, if the load on the second heating coil 7 is removed, a large current flows through the second heating coil 7 to damage the apparatus in the worst case.

Therefore, the operating frequencies are set in the induction heating cooker of the fourth embodiment as follows.

The first operating frequency (fa) on the low frequency side is higher than the resonant frequency of the first resonant circuit 17 including various loads when placed on the first heating coil 6, and needs to be set lower than the resonant frequency (fc) at the time of no load of the second resonant circuit 18. Preferably the first operating frequency (fa) is selected so that the power characteristic at the time of no load of the second resonant circuit 18 may not be larger than ½ of a rated power. By setting the first operating frequency (fa) in such a manner, even if the load on the second heating coil 7 is removed in condition where both of the first heating coil 6 and the second heating coil 7 are performing heating operations, no large current occurs in the second heating coil 7, thereby enabling stabilizing the operations.

The first operating frequency (fa) set for the first heating coil 6 is higher than the resonant frequency (f1) in condition where a load is placed on the first heating coil 6 and, naturally, the first operating frequency (fa) is higher than the resonant frequency at the time of no load of the first heating coil 6.

In a case where the same load is heated by the first heating coil 6 and the second heating coil 7, by separating the first resonant frequency of the first resonant circuit 17 and the second resonant frequency of the second resonant circuit 18 from each other by at least 20 kHz, the above relationship between the first operating frequency (fa) and the resonant frequencies of the respective resonant circuits can be satisfied easily. Further, by thus separating the first resonant frequency and the second resonant frequency from each other by at least 20 kHz, the power supplied to one of the heating coils 6 and 7 is dominant due to the set first operating frequency (fa), thereby providing an advantage in that the heating coils 6 and 7 can be controlled easily.

As hereinabove described, in the induction heating cooker of the fourth embodiment, by setting the operating frequency on the low frequency side higher than the resonant frequency of the low frequency side and lower than the resonant frequency at the time of no loss on the high frequency side, it is possible to continue stable heating operations even if the load on the high frequency side is removed during the heating operations.

Fifth Embodiment

Next, a description will be given of an induction heating cooker as one example of the induction heating apparatus of a fifth embodiment according to the present invention with reference to the accompanying drawings. The induction heating cooker of the fifth embodiment is the same as the first embodiment except that a plurality of heating coils are disposed differently and have their respective external sizes. Therefore, in the description of the fifth embodiment, identical reference numerals are given to components including the identical function and structure the identical function and structure in the induction heating cooker of the first embodiment, and the description of the first embodiment is applied to the fifth embodiment.

Figure 15A:
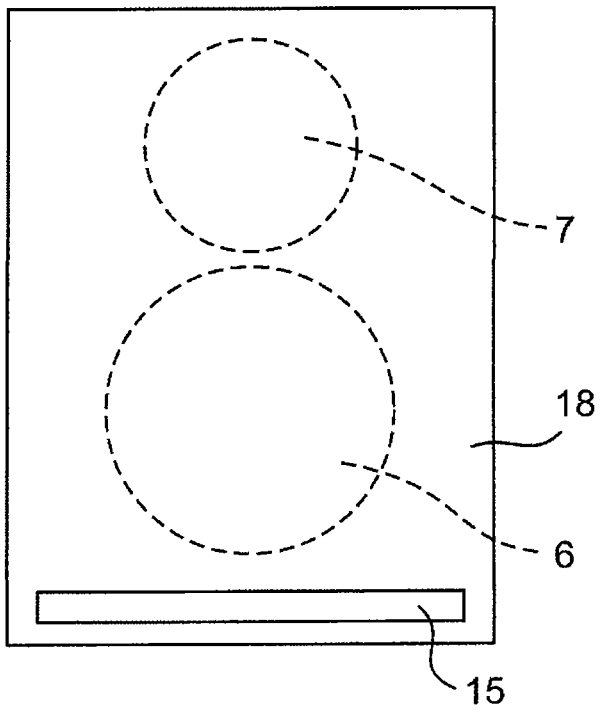
FIG. 15A is a plan view showing an external configuration of the induction heating cooker of a fifth embodiment according to the present invention.
Figure 15B:
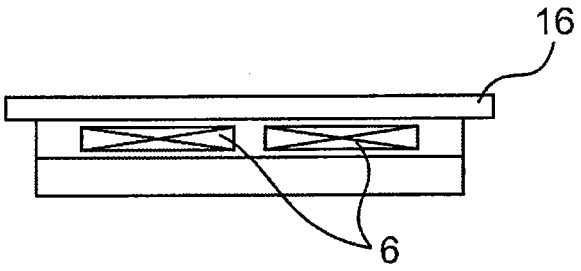
FIG. 15B is a cross-sectional view showing an outlined internal configuration of the induction heating cooker of the fifth embodiment.
Figure 16:
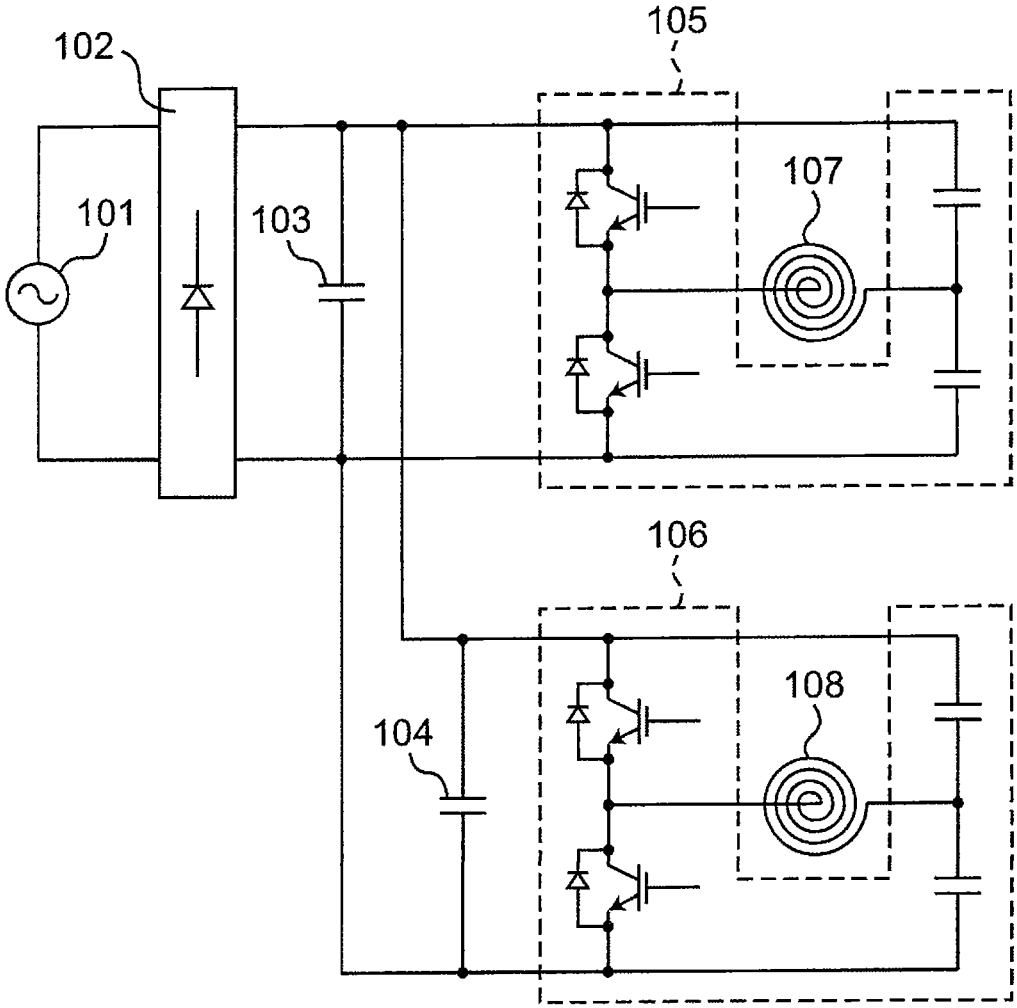
Fig.16 Prior Art
FIG. 16 is the schematic diagram showing the configuration of the conventional induction heating apparatus.

FIG. 15A is a plan view showing an external configuration of the induction heating cooker of the fifth embodiment according to the present invention and FIG. 15B is a cross-sectional view showing an outlined internal configuration of the induction heating cooker of the fifth embodiment. As shown in FIG. 15A, in the induction heating cooker of the fifth embodiment, of two heating coils 6 and 7 disposed under a top plate 16, the larger shaped first heating coil 6 is disposed toward the front side (user side) and the smaller shaped second heating coil 7 is disposed to the rear side. At more toward the front side of the first heating coil 6, an operation display portion 15 is mounted which displays operations and states of the relevant induction heating cooker.

In a half-bridge inverter or a full-bridge inverter in which a heating coil and a resonant capacitor are connected in series with each other, by setting the drive frequency higher than a resonant frequency determined by the inductance of the heating coil including the load such as a pan and the capacitance of the resonant capacitor and shifting the drive frequency in a direction away from the resonant frequency, the material and the shape of the load are accommodated and the power is adjusted. Therefore, in many cases, the resonant frequency and the drive frequency at the time of the maximum power are close to each other.

In the induction heating cooker of the fifth embodiment, it is necessary to make the frequency characteristic of a first resonant circuit 17 (refer to FIG. 1) including the first heating coil 6 and the first resonant capacitor 11 different from that of a resonant circuit 18 including the second heating coil 7 and a second resonant capacitor 12. Since the resonant frequency is inversely proportional to the roots of products of the inductance values of the heating coils 6 and 7 and the capacitance values of the resonant capacitors 11 and 12 respectively, it is necessary to suppress the products of the conductance values of the heating coils 6 and 7 and the capacitance values of the resonant capacitors 11 and 12 respectively.

The inductance value of the heating coil increases in proportion to the square of the number of turns and the outer diameter. Therefore, the small-shaped heating coil that has a small diameter and cannot increase the number of turns has a small inductance value.

To solve the problem, by setting high the resonant frequency (f2: refer to FIG. 2) of the second resonant circuit 18 including the small-shaped second heating coil 7, a different in frequency can easily be given with respect to the resonant frequency of the first resonant circuit 17. Therefore, in the induction heating cooker of the fifth embodiment, it is possible to decrease the number of turns of the second heating coil 7 having a small shape and a small inductance value, to inhibit the thickness of the second heating coil 7 from increasing, thereby keeping a good energy transmission efficiency between the second heating coil 7 and the load.

By increasing the maximum input power to the large-shaped first heating coil 6, it is possible to suppress the maximum power of the second heating coil 7 operating at a high frequency where losses of an inverter 4 increase, thereby preventing an increase in loss of the inverter 4.

Even in a case where the first heating coil 6 and the second heating coil 7 have the same shape, by setting the resonant frequency of the heating coil having the smaller maximum input power higher than the other, the inverter losses can be suppressed.

As hereinabove described, in the induction heating cooker of the fifth embodiment, by setting the resonant frequency of one of the heating coils 6 and 7 which has a smaller diameter to be higher than that of the other, the inductance of the smaller-diameter heating coil can be reduced. As a result, by the configuration of the fifth embodiment, it is possible to make the smaller-shaped heating coil thinner to keep a good energy transmission efficiency between the heating coil and the load and facilitate designing for cooling, thereby realizing a noiseless induction heating apparatus.

INDUSTRIAL APPLICABILITY

The present invention is useful in application in the field of an induction heating apparatus that can heat a plurality of subjects simultaneously by utilizing induction heating and can be applied to a variety of induction heating apparatuses.

The invention claimed is:

1. An induction heating apparatus comprising:

a smoothing circuit to which a rectified power from an AC power supply is input;

an inverter in which the smoothed power is input to a set of semiconductor switch circuits from the smoothing circuit, and which is configured to output a periodic drive signal having a first operating frequency during a first time period, and a second operating frequency during a second time period;

a plurality of heating coils which are supplied with the drive signals from the inverter, wherein each of the plurality of heating coils is connected to one of a plurality of capacitance circuits so that each heating coil has a resonant frequency that matches one of the two operating frequencies; and a control portion for controlling the operating frequencies and the operation period of time to drive the semiconductor switch circuit, wherein the control portion is configured to select the first operating frequency and the second operating frequency to simultaneously set a first average power delivered to a first heating coil to a first power value, and a second average power delivered to a second heating coil to a second power value, to thereby heat a first load disposed on the first heating coil with the first average power and to heat a second load disposed on the second heating coil with the second average power.

2. The induction heating apparatus according to claim 1, wherein the set of the semiconductor switch circuits is formed by a series circuit including two semiconductor switches, and by alternating turn-on and turn-off operations of the two semiconductor switches, the smoothed power from the smoothing circuit is supplied to the plurality of heating coils connected to a connecting point of the two semiconductor switches connected in series.

3. The induction heating apparatus according to claim 2, wherein the plurality of heating coils are respectively connected in series with a plurality of capacitance circuits provided in the inverter, and a plurality of resonant circuits including the plurality of heating coils and the plurality of capacitance circuits have different resonant frequency values in frequency characteristics, respectively.

4. The induction heating apparatus according to claim 3, wherein each of the series circuits that include the plurality of heating coils and the plurality of capacitance circuits is connected between the connecting point of the two semiconductor switches connected in series and one output terminal of the smoothing circuit.

5. The induction heating apparatus according to claim 3, wherein each of the plurality of capacitance circuits includes a plurality of capacitance elements and connected in parallel with the smoothing circuit, and each of the plurality of heating coils is respectively connected between nodes between the capacitance elements of the capacitance circuits and the connecting point of the two semiconductor switches connected in series.

6. The induction heating apparatus according to claim 4, further comprising a switching portion fitted to each of the series circuits that include the plurality of heating coils and the plurality of capacitance circuits for enabling each of the plurality of heating coils to be disconnected from or connected to the inverter.

7. The induction heating apparatus according to claim 5, wherein a switching portion is fitted to each of the plurality of heating coils so as to enable each of the plurality of heating coils to be disconnected from or connected to the inverter.

8. The induction heating apparatus according to claim 3, wherein the first operating frequency is higher than the resonant frequencies of the plurality of resonant circuits and the second operating frequency is set in a middle range of the resonant frequencies of the plurality of resonant circuits.

9. The induction heating apparatus according to claim 3, wherein at least one of the at least one of the first and second operating frequencies is different than the resonant frequency at the time of no load where no to-be-heated object is placed.

10. The induction heating apparatus according to claim 3, wherein at least one of the first and second operating frequencies is set in a range other than the frequency range that denotes at least ½ of a maximum input power in the frequency characteristic at the time of no load where no to-be-heated object is placed.

11. The induction heating apparatus according to claim 3, wherein an antiparallel diode is connected with each of the two semiconductor switch, so that in alternate turn-on/-off operations of the two semiconductor switches, each of those semiconductor switches is turned on at timing when a current starts to flow through this diode.

12. The induction heating apparatus according to claim 3, wherein there is at least 20 kHz between the respective resonant frequencies in the frequency characteristics of the plurality of resonant circuits.

13. The induction heating apparatus according to claim 3, wherein the control portion is configured to control the operating frequencies and operation periods of time of the drive signals output from the inverter, based on an input current from the AC power supply and an input power to the heating coils.

14. The induction heating apparatus according to claim 3, wherein the control portion is configured to determine the operation periods of time of the drive signals output from the inverter based on the input current from the AC power supply and the input power to the heating coils and then control a duty ratio of the semiconductor switches to thereby control powers to be supplied to the heating coils.

15. The induction heating apparatus according to claim 3, wherein the plurality of heating coils have external shapes having different coil diameters, so that the resonant frequency of the resonant circuit including the heating coil having the smaller diameter is set higher than that of the resonant circuit including the heating coil having the larger diameter.

* * * * *